US005113229A

United States Patent [19]

Higashio et al.

[11] Patent Number: 5,113,229

[45] Date of Patent: May 12, 1992

[54] MULTI-COLOR COPYING MACHINE HAVING A SIMULTANEOUS COLOR COPY MODE AND AN EDITED AREA COPY MODE

[75] Inventors: Kimihiko Higashio; Masazumi Ito; Kadotaro Nishimori, all of Osaka, Japan

[73] Assignee: Minolta Camera Kabushiki Kaisha, Osaka, Japan

[21] Appl. No.: 384,732

[22] Filed: Jul. 25, 1989

[30] Foreign Application Priority Data

Jul. 26, 1988 [JP] Japan ..... 63-186350
Aug. 31, 1988 [JP] Japan ..... 63-219541

[51] Int. Cl.[5] ..... G03G 15/01

[52] U.S. Cl. ..... 355/326; 355/200; 355/218

[58] Field of Search ..... 355/326, 218, 327, 328, 355/215, 210, 202, 200, 55, 60, 61

[56] References Cited

U.S. PATENT DOCUMENTS 3,914,043 10/1975 McVeigh .
4,413,899 11/1983 Karasawa et al. ..... 355/218 X
4,627,707 12/1986 Tani et al. .
4,794,421 12/1988 Stoudt et al. ..... 355/218 X
4,803,520 2/1989 Tomosada et al. ..... 355/218
4,814,824 3/1989 Ito et al. .
4,860,049 8/1989 Toshimitsu et al. ..... 355/218
4,862,216 9/1989 Higashi et al. ..... 355/218
4,862,217 8/1989 Russel ..... 355/218
4,862,219 8/1989 Yoshida et al. ..... 355/218 X
4,866,486 9/1989 Higashio et al. ..... 355/251 X
4,924,264 5/1990 Ito et al. .

FOREIGN PATENT DOCUMENTS 61-203474 9/1986 Japan .

*Primary Examiner*—A. T. Grimley
*Assistant Examiner*—Thu A. Dang
*Attorney, Agent, or Firm*—Burns, Doane, Swecker & Mathis

[57] ABSTRACT

A copying machine including a specifying unit movable along the document support for specifying a particular point and operable to divide an area of the document support into a first area, delimited between the exposure start position to the particular point, and a second area delimited between the particular point and the exposure terminating position; a first developing unit with a mass of developing material of first color therein and operable to develop an electrostatic latent image into a visible powder image, a second developing unit with a mass of developing material of second color therein and operable to develop the electrostatic latent image into a visible powder image, and an erasing unit for erasing the electrostatic latent image before the electrostatic latent image is developed by one of the first and second developing unit; a mode specifying unit for specifying relative to the first and second areas one of a first mode in which the electrostatic latent image on the photosensitive medium is developed into the visible powder image of first color with the use of the first developing unit, a second mode in which the electrostatic latent image on the photosensitive medium is developed into the visible powder image of second color with the use of the second developing unit, and a third mode in which the electrostatic latent image on the photosensitive medium is erased with the use of the erasing unit.

5 Claims, 24 Drawing Sheets

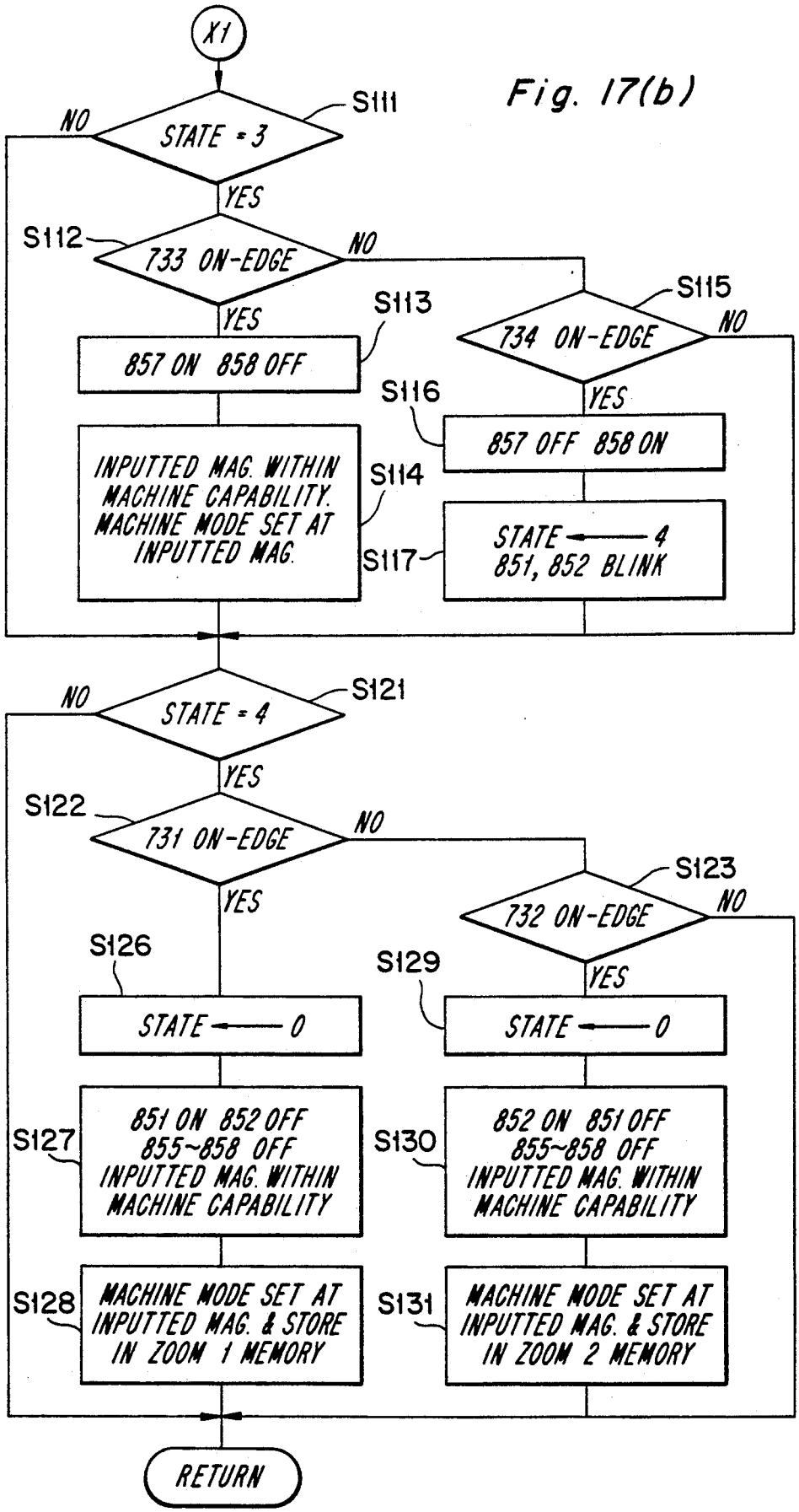
X1
Fig. 17(b)
S111
STATE = 3
NO
YES
S112
733 ON-EDGE
NO
YES
S113
857 ON 858 OFF
S115
734 ON-EDGE
NO
YES
S116
857 OFF 858 ON
INPUTTED MAG. WITHIN MACHINE CAPABILITY. MACHINE MODE SET AT INPUTTED MAG.
S114
STATE ← 4
851, 852 BLINK
S117
S121
STATE = 4
NO
YES
S122
731 ON-EDGE
NO
YES
S123
732 ON-EDGE
NO
YES
S126
STATE ← 0
S129
STATE ← 0
S127
851 ON 852 OFF
855~858 OFF
INPUTTED MAG. WITHIN MACHINE CAPABILITY
S130
852 ON 851 OFF
855~858 OFF
INPUTTED MAG. WITHIN MACHINE CAPABILITY
S128
MACHINE MODE SET AT INPUTTED MAG. & STORE IN ZOOM 1 MEMORY
S131
MACHINE MODE SET AT INPUTTED MAG. & STORE IN ZOOM 2 MEMORY
RETURN

PROGRAM INPUT

727 ON-EDGE
S300
NO
YES
S301
STATE=0
NO
YES
853.854 BLINK
STATE ← 31
S302
S303
STATE=31
NO
YES
S304
853.854 OFF
STATE ← 0
STATE=31
NO
S310
YES
733 ON-EDGE
NO
S311
YES
S314
734 ON-EDGE
NO
S312
YES
S315
853 ON
854 OFF
854 ON
853 OFF
STORE MODE IN
PROGRAM 1
MEMORY
STORE MODE IN
PROGRAM 2
MEMORY
S313
S316
STATE ← 0
S317
RETURN

MULTI-COLOR COPYING MACHINE HAVING A SIMULTANEOUS COLOR COPY MODE AND AN EDITED AREA COPY MODE

BACKGROUND OF THE INVENTION

1. Field of the Invention

The present invention generally relates to a multi-color copying machine and, more particularly, to the multi-color copying machine of the type having a simultaneous color copy mode (hereinafter referred to as a "color simulcopy mode"), in which, after a document to be copied has been divided into a desired number of areas and these areas are subsequently reproduced on a copying sheet in different colors during a single run of copying operation, that is, during a single copy run, and a composite color copy mode (hereinafter referred to as an "area edited copy mode") in which, after a document to be copied has been divided into a desired number of areas by specifying points in coordinate system on the document and these areas are subsequently reproduced on a copying sheet in different colors.

2. Description of the Prior Art

A multi-color image forming apparatus having the color simulcopy mode is disclosed in, for example, the Japanese Laid-open Pat. Publication No. 63-787, which corresponds to U.S. Pat. No. 4,862,216. According to this known multi-color image forming apparatus, the division of the document to be copied into the plural areas is carried out in a direction parallel to the direction in which the document is scanned and two areas so divided of the document can be copied in either different colors or, although identical in color, in different tones to differentiate those areas from each other.

However, according to the conventionally practiced color simulcopy mode, the order of arrangement of colors and the order of arrangement of tones are fixed and cannot be altered according to the will of an operator of the image forming apparatus, thereby posing a problem associated with the limited freedom of selection of a combination of colors or tones.

On the other hand, in a copying machine having the area edited copy mode wherein, after the document to be copied has been divided into a desired number of areas by specifying points in a coordinate system on the document and these areas are subsequently reproduced on a copying sheet in different colors, the copying operation is repeated a number of runs. Therefore, if one of developing units accommodation developing material of different colors is selectively brought into operation during each of the runs of copying operation, a multi-color copy can be obtained and, therefore, a relatively large freedom of selection of a combination of colors can be appreciated. In such case, however, the necessity of the repetition of the copying operation through a number of runs make it impossible to give a multi-color copy during any single run of copying operation such as is accomplished during the color simulcopy mode.

With an increasing demand in the market for a copying machine having a variety of functions, capabilities and modes, a copying machine having both the color simulcopy mode and the area edited copy mode is suggested in, for example, U.S. Ser. No. 139,311.

However, the greater the number of the available functions, capabilities, and modes provided in the copying machine, the more complicated is the control panel for specifying a particular one or ones of the functions, capabilities and modes.

SUMMARY OF THE INVENTION

Accordingly, an essential object of the present invention is to provide an improved copying machine of a type wherein a relatively large freedom of combinations can be accomplished during the color simulcopy mode to cope with various needs from potential users of the copying machine.

Another important object of the present invention is to provide an improved copying machine of the type referred to above having both of the color simulcopy mode and the area edited copy mode, wherein the control panel is simplified.

BRIEF DESCRIPTION OF THE DRAWINGS

These and other objects and features of the present invention will become clear from the following description taken in conjunction with a preferred embodiment thereof with reference to the accompanying drawings, in which.

DETAILED DESCRIPTION OF THE INVENTION

Figure 1:
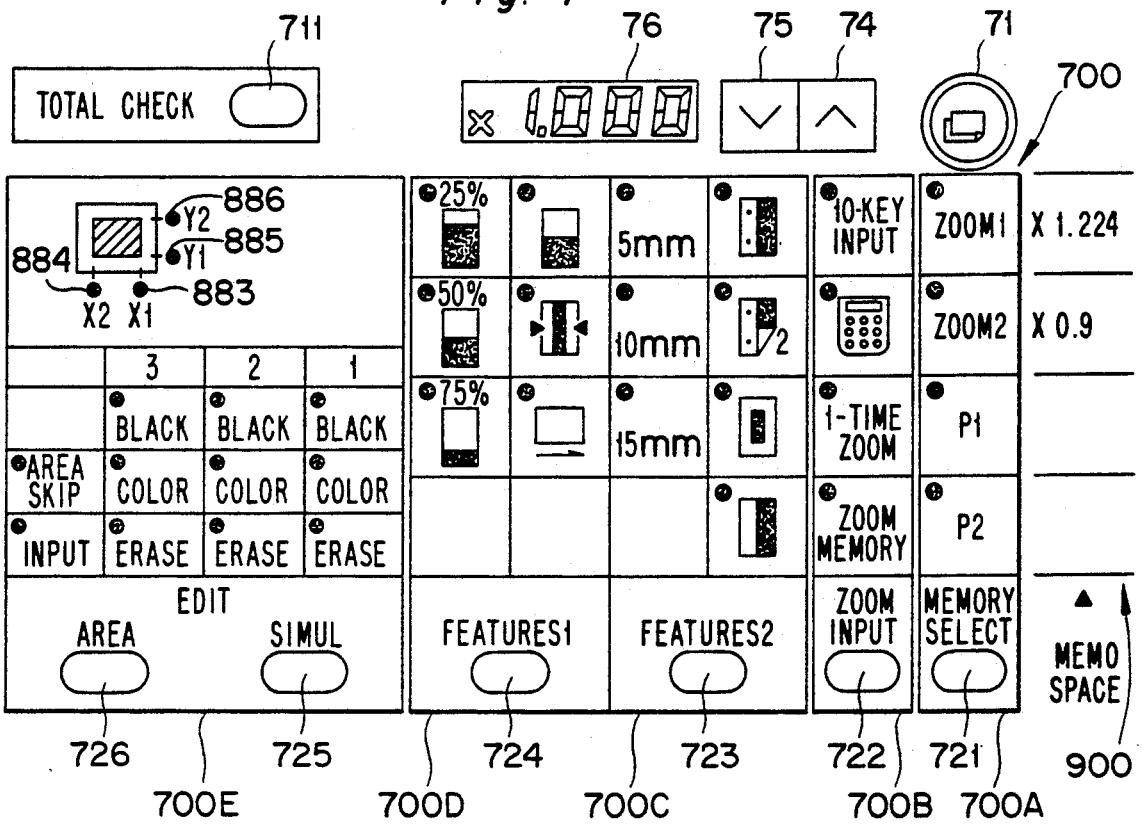
FIG. 1 is a fragmentary plan view, on an enlarged scale, showing a control panel used in a copying machine embodying the present invention.

Before the description of the present invention proceeds, it is to be noted that like parts are designated by like reference numerals throughout the accompanying drawings. It is also to be noted that, for the purpose of facilitating the easy and better understanding of the present invention, the details of the present invention will be described under separate headings.

(a) Structure of Copying Machine

Figure 2:
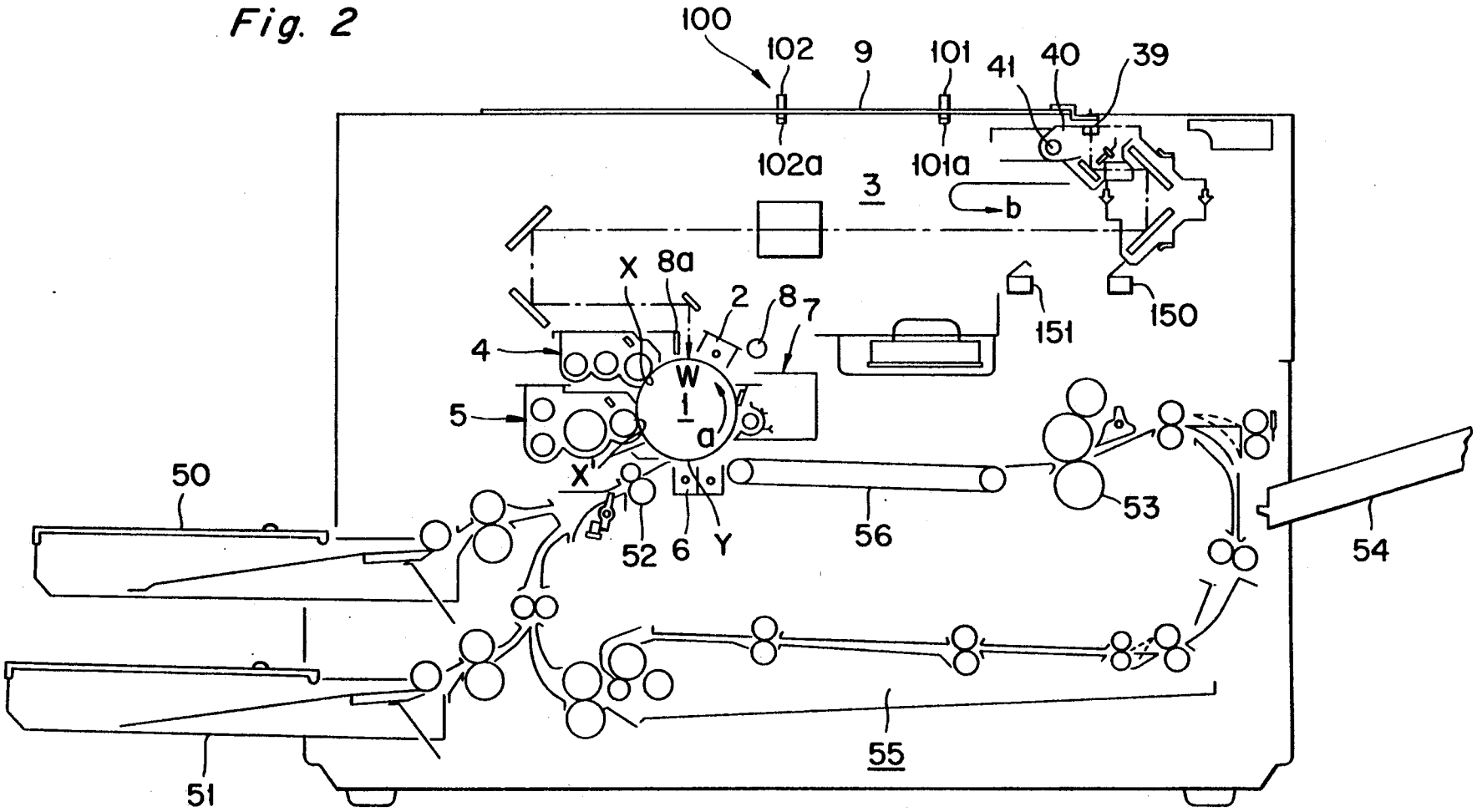
FIG. 2 is a schematic side sectional view of the copying machine embodying the present invention.

FIG. 2 illustrates, in schematic side sectional view, a bi-color copying machine which may be one of the image forming apparatus to which the present invention is applicable. The structure of the bi-color copying machine will hereinafter be described as used for the reproduction of an image of a document in the form as presented in such document, that is, as set in a standard copy mode.

Assuming that a photoreceptor drum 1 is rotated about its longitudinal axis in a direction shown by the arrow a, a -photosensitive surface of the photoreceptor drum 1 is imparted a predetermined potential by the discharge effected by a charger 2.

A scanner 40 having an illuminating lamp 41 included in an optical system 3 then undergoes a scanning motion in a direction shown by the arrow b with the illuminating lamp 41 sequentially illuminating a document placed on a transparent document support 9 so that imagewise rays of light reflected from the document on the transparent document support 9 can be subsequently projected through mirrors and a lens assembly onto the photosensitive surface of the photoreceptor drum 1 at an exposure station W. When the imagewise rays of light are so projected onto the photosensitive surface of the photoreceptor drum 1, an electrostatic latent image corresponding-to the image of the document to be copied is formed on the photosensitive surface of the photoreceptor drum 1.

An interimage eraser 8*a* employed in the form of a row of light emitting diodes discharges portion of the potential of the photosensitive surface of the photoreceptor drum 1 outside defined image areas including an area between the neighboring images.

The electrostatic latent image is subsequently developed at either a first developing station X or a second developing station X' into a visible powder image as a result of supply of toner material from an associated first or second developing unit 4 or 5, which visible powder image is a replica of the image of the document on the transparent document support 9.

On the other hand, a copying paper supplied selectively from one of paper feed units 50 and 51 and being conveyed towards a transfer station Y where a transfer charger 6 is disposed so as to confront the photoreceptor drum 1 is subsequently supplied onto the transfer station Y by means of a timing roller pair 52 operable to feed the copying paper to the transfer station Y in synchronism with the arrival of the visible powder image on the photoreceptor drum 1 at the transfer station Y. At the transfer station Y, and during the continued rotation of the photoreceptor drum 1 while the copying paper is being passed through the transfer station Y, the visible powder image on the photoreceptor drum 1 can be transferred onto the copying paper which is in turn conveyed by a conveyor belt 56 towards a fixing station and passed through a gap between paired fixing rollers 53 for permanently fixing the powder image on the copying paper. The copying paper having the image permanently fixed on one of its opposite sides is then ejected onto a copy receiving tray 54.

Where any one of a duplex copy mode and a composite copy mode is selected, the copying paper once ejected onto the copy receiving tray 54 is transported to a duplexing unit 55 so that the copying paper can be turned upside down in the case of a duplex copying. The copying paper so transported to the duplexing unit 55 is again transported to the transfer station Y for receiving a visible powder image developed on the photosensitive surface of the photoreceptor drum 1 during the next succeeding run of copying operation. This visible powder image developed during the next succeeding run of copying operation is transferred at the transfer station Y onto the opposite side of the same copying paper to form a duplex copy or onto the same side of the copying paper to form a composite copy.

On the other hand, residue toner remaining on the photosensitive surface of the photoreceptor drum 1 is removed by a cleaning unit 7 and residue charge on the photosensitive surface of the photoreceptor drum 1 is erased by the radiation of rays of light from an eraser lamp 8, in readiness for the next run of copying operation.

The copying machine operable in the manner as hereinabove described has, in addition to the capabilities of making the duplex copy and the composite copy, a capability of making a simultaneously colored copy in which, so far illustrated, during a single run of copying operation, different areas of a copying sheet can be reproduced in two different colors. This can be accomplished when the copying machine is set in the color simulcopy mode referred to hereinbefore. For this purpose, each of the first and second developing units 4 and 5 is equipped with a special mechanism.

Figure 3:
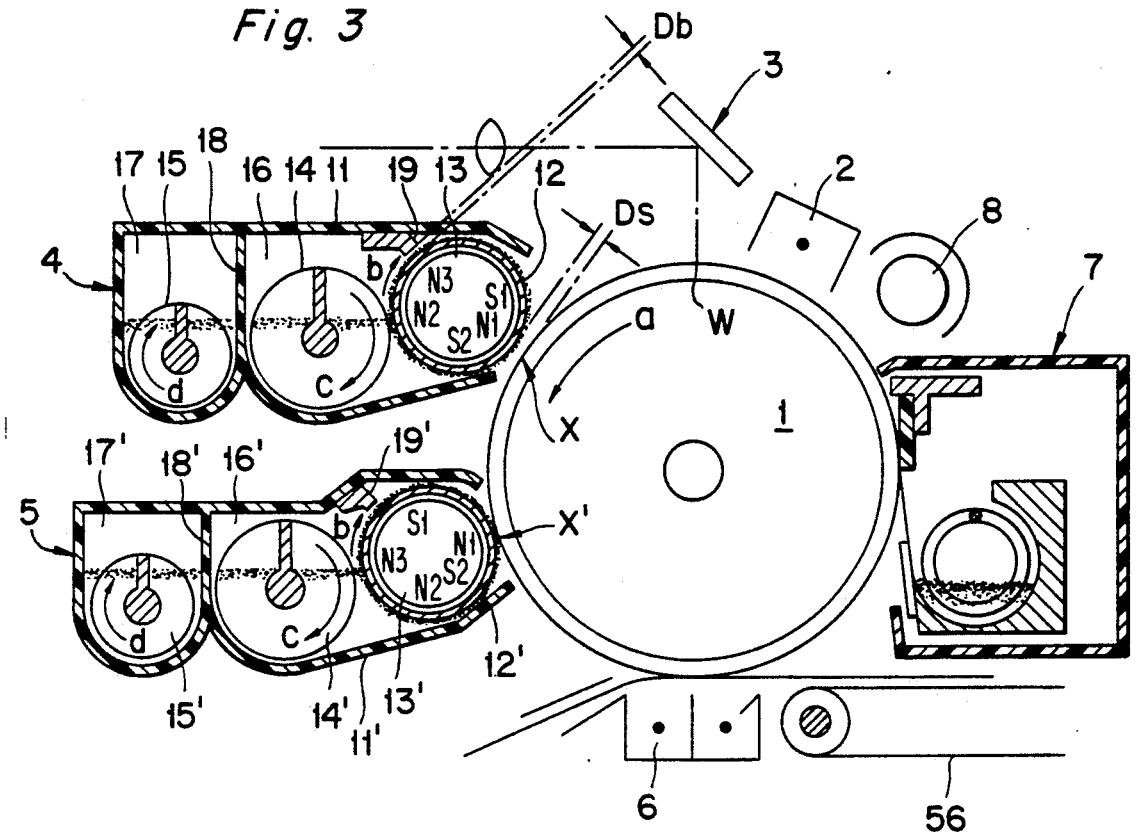
FIG. 3 is a side sectional view, on an enlarged scale, showing a photoreceptor drum and some of the component parts disposed around the photoreceptor drum in the copying machine embodying the present invention.
Figure 4:
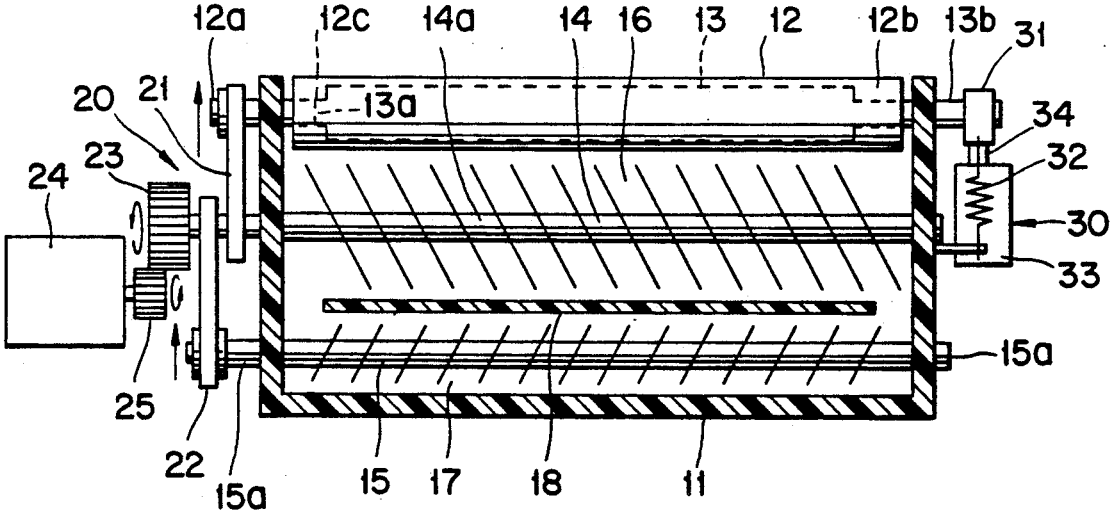
FIG. 4 is a longitudinal sectional view, on an enlarged scale, showing one of two illustrated developing units.

The details of each of the developing units 4 and 5 will now be discussed. It is, however, to be noted that the first and second developing units 4 and 5 are of identical construction as shown in FIGS. 3 and 4. Therefore, while the details of one of the first and second developing units, for example, the first developing unit 4, will be described with reference to FIGS. 3 and 4, components of the second developing unit 5 which are similar in structure and function to the components described with reference to FIGS. 3 and 4 will be referred to with like reference numerals, except that the reference numerals will have the prime (') to refer to the components of the second developing unit 5 and that the first developing unit 4 is used to accommodate a developing material composed of a mass of magnetic carrier beads and a mass of electrically insulating color toner whereas the second developing unit 5 is used to accommodate a developing material composed of a mass of magnetic carrier beads and a mass of electrically insulating black toner.

The developing unit 4 comprises a developer tank 11 within which a developing sleeve 12, a supply roll 14 and a screw feeder 15 are operatively accommodated in this order in a direction away from the photoreceptor drum 1.

The developing sleeve 12 is in the form of a generally hollow cylinder made of non-magnetizable, electroconductive material and has an outer peripheral surface formed with minute indentations by the use of any known sand-blasting technique. This developing sleeve 12 is so supported and so positioned within the developer tank 11 as to form a developing gap Ds at a location where the outer peripheral surface of the developing sleeve 12 is spaced the minimum distance from that portion of the photosensitive surface of the photoreceptor drum 1 that is aligned with the associated developing station X or X'. At a location on one side of the developing sleeve 12 opposite to the associated developing station X or X', a bristle height regulating member 19 is secured to an upper portion of the developer tank 11 so as to confront the developing sleeve 12 while forming a bristle height regulating gap Db between the bristle height regulating member 19 and the outer peripheral surface of the developing sleeve 12.

The supply roll 14 and the screw feeder 15 are disposed within the developer tank 11 and in respective delivery passages 16 and 17 partitioned from each other by means of a partition wall 18. As best shown in FIG. 4, the delivery passages 16 and 17 communicate with each other at opposite ends of the developer tank 11.

As best shown in FIG. 4, when a drive motor 24 is operated, a drive gear 25 and a driven gear 23 meshed therewith are driven to drive endless belts 21 and 22 which in turn drive support shafts 12*a*, 14*a* and 15*a* thereby to rotate the developing sleeve 12, the supply roller 14 and the screw feeder 15 in respective directions shown by the arrows b, c and d in FIG. 3. Consequent upon this rotation, the developing material can be conveyed towards the developing sleeve 12 through the screw feeder 15 and then through the supply roller 14. The developing material so conveyed towards the developing sleeve 12 is subsequently passed through the bristle height regulating gap between the bristle height regulating member 19 and the developing sleeve 12 and then towards the associated developing station X or X'.

Within the developing sleeve 12, there is accommodated a magnet roll 13 comprised of a plurality of elongated magnets $N_1$, $N_2$, $N_3$, $S_1$ and $S_2$ disposed with their longitudinal axes lying parallel to the longitudinal axis of the developing sleeve 12. (It is to be noted that characters "N" and "S" used in connection with the reference characters to denote the magnets within the developing sleeve 12 represent opposite poles.)

As best shown in FIG. 4, the magnet roll 13 has stud shafts 13*a* and 13*b* opposite to each other, the stud shaft 13*a* being received in a bearing recess 12*c* formed in the interior of the developing sleeve 12 whereas the stud shaft 13*b* is rotatably extending through a side wall portion of the developer tank 11. An outer end of the stud shaft 13*b* situated outside the developer tank 11 supports a generally intermediate portion of a lever 31 having one end biased by a biasing spring 32 and the other end to which an plunger 34 of a solenoid unit 33 is engaged. Accordingly, when the solenoid unit 33 is driven, the lever 31 can be rotated against the biasing force of the biasing spring 32 to rotate the magnet roll 13 through a predetermined angle about the longitudinal axis thereof.

In the first developing unit 4, in a condition wherein the solenoid unit 33 is activated and the motor 24 is not driven, the screw feeder 15, the supply roller 14 and the developing sleeve 12 are all held still and no developing material is consequently supplied. During this condition, the magnet $N_3$ is in position to confront the bristle height regulating member 19 while the developing station X lies intermediate between the magnets $N_1$ and $S_1$. By the effect of magnetic lines of force developed by the magnets forming the magnet roll 13, the developing material piles up on the outer surface of the developing sleeve 13, forming thicker layers of developing material in the vicinity of the magnets $N_1$ to $N_3$, $S_1$ and $S_2$ and a thin layer of developing material between each neighboring magnets. Accordingly, the bristle height regulating gap between the developing sleeve 12 and the bristle height regulating member 19 is closed by the developing material and, since the layer of developing material on a portion of the outer peripheral surface of the developing sleeve 13 confronting the developing station X is thin, no developing material will adhere to the photosensitive surface of the photoreceptor drum 1.

In the second developing unit 5, in a condition wherein the solenoid unit 33' is not activated and the motor 24' is driven, the screw feeder 15', the supply roller 14' and the developing sleeve 12' are all rotated with the developing material consequently supplied. At this time, the bristle height regulating member 19' confronts a portion intermediate between the magnets $N_3$ and $S_1$ with the bristle height regulating gap clear of any developing material and, therefore, the developing material can be transported towards the developing station X" which then confronts the magnet $N_1$. In this condition, the developing material piles up on the outer surface of the developing sleeve 13', forming a thicker layer of developing material in the vicinity of the magnets $N_1$ and, accordingly, the developing material can readily adhere to the photosensitive surface of the photoreceptor drum 1.

(b) Area Specifying Mechanism For Color Simulcopy Mode

Figure 5:
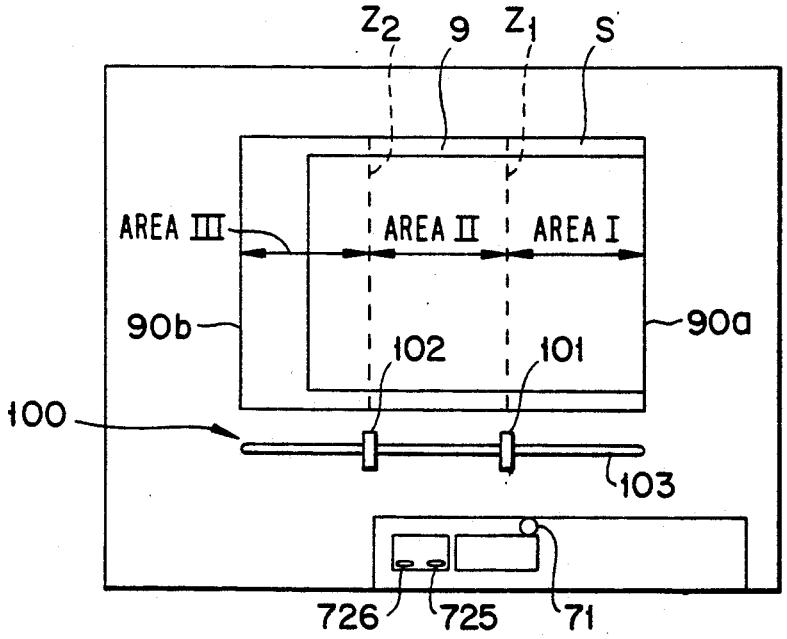
FIG. 5 is a schematic top plan view of an area specifying mechanism used in the copying machine embodying the present invention.

An area specifying mechanism is best shown in FIG. 5 and generally identified by 100.

Referring now to FIG. 5, the area specifying mechanism 100 comprises first and second slide levers 101 and 102 positioned adjacent one of opposite sides of the transparent document support 9. Each of the first and second slide levers 101 and 102 is slidable along a guide groove 103 formed along one side of the transparent document support 9 to define a respective line Z1 or Z2 of division of the document support 9 into a plurality of areas, for example, three in the illustrated embodiment, in a direction parallel to the direction (shown by the arrow b in FIG. 2) of movement of the scanner 40. Each of the first and second slide levers 101 and 102 extends downwardly through the guide groove 103 with its respective lower end situated within a machine housing and carrying a respective magnet 101*a* or 102*a* secured thereto as best shown in FIG. 2. These magnets 101*a* and 102*b* are used to detect the respective positions of the slide levers 101 and 102 in cooperation with a reed switch 39 carried by the scanner 40 as will be described later.

As shown in FIG. 5, the line Z1 of division defined by the position of the slide lever 101 and traversing the transparent document support 90 in a direction perpendicular to the direction of movement of the scanner 40 defines an AREA I between it and a leading end 90*a* of the transparent document support 90 with respect to the direction of movement of the scanner 40 from a start position towards a scanned position. The line Z2 of division defined by the position of the slide lever 102 and similarly traversing the transparent document support 90 in parallel relation with the line Z1 of division defines an AREA II between it and the line Z1 of division and also defines an AREA III between the line Z2 of division and a trailing end 90*b* of the transparent document support 90 with respect to the direction of movement of the scanner 40 towards the scanned position.

(c) Operating Panel

Figure 6:
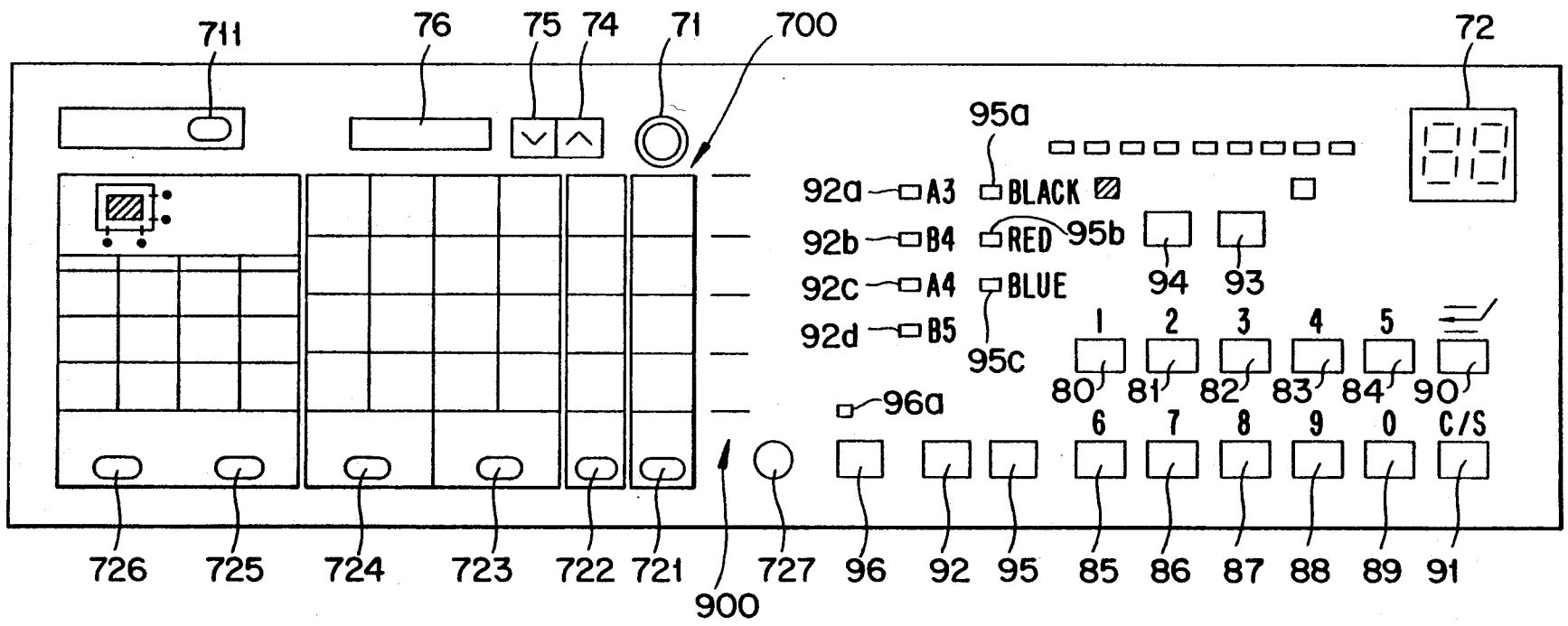
FIG. 6 is a plan view of the control panel.

The operating panel disposed on the top of the machine housing is illustrated in FIG. 6. The operating panel shown therein includes a print button 71; an LED display 72 for the display of the number of copies to be made; a magnification up-shift key 74 (or an enlargement select key) for selecting one of a plurality of magnification factors when an images is desired to be enlarged in scale; a magnification down-shift key 75 (or a reduction select key) for selecting one of a plurality of magnification factors when an image is desired to be reduced in scale; a magnification display 76; ten numerical keys 80 to 89; an interrupt key 90; a clear/stop key 91; a paper select key 92; paper size select displays 92*a*, 92*b*, 92*c* and 92*d* for providing visual indications that A3-, B4-, A4- and B5-size papers have been selected, respectively; an exposure up key 93; an exposure down key 94; a color select key 95; color displays 95*a* to 95*c*; an equal-magnification select key 96; a magnification select display 96*a*; a touch panel portion 700 (the details thereof being shown in FIGS. 1 and FIGS. 7 to 9); a total value read-out key 711; menu keys 721 to 726; a program input key 727; select keys 731 to 734 (See FIG. 7); displays 872 to 886 associated with the simulcopy and area edited copy modes (See FIG. 8); and a blank area for use by an user of the copying machine for labelling user-defined magnification factors, contents of programs and other pieces of information all stored in a memory in the copying machine (See FIGS. 1 and 7).

Figure 7:
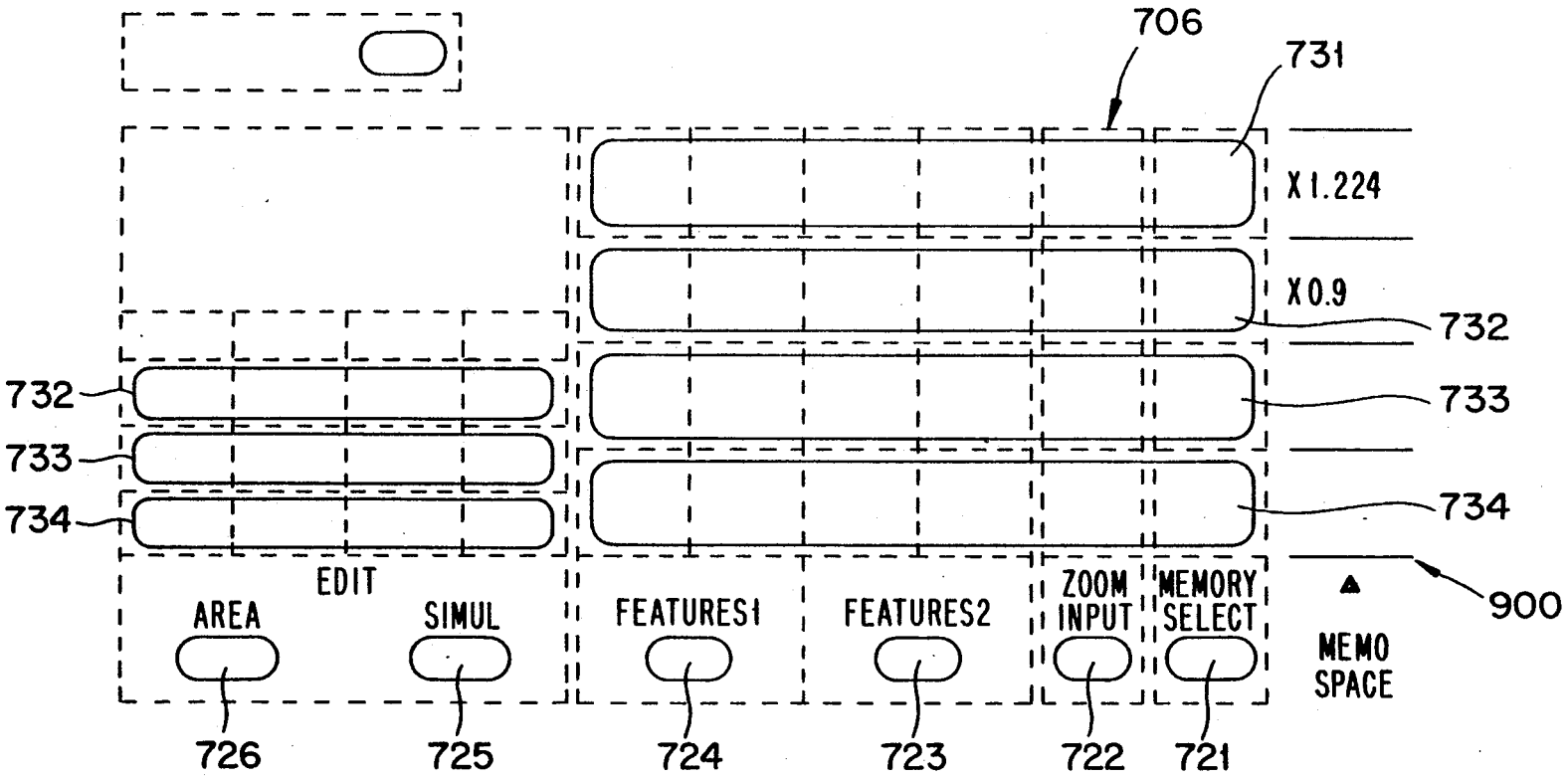
FIG. 7 is a diagram showing an arrangement of menu keys and selection keys.
Figure 9:
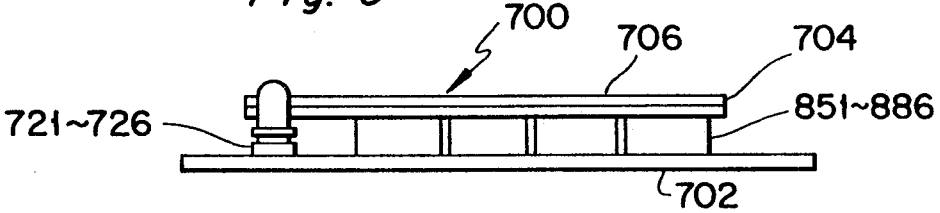
FIG. 9 is a sectional view, on an exaggerated scale, of a touch panel used in the control panel.
Figure 10A:
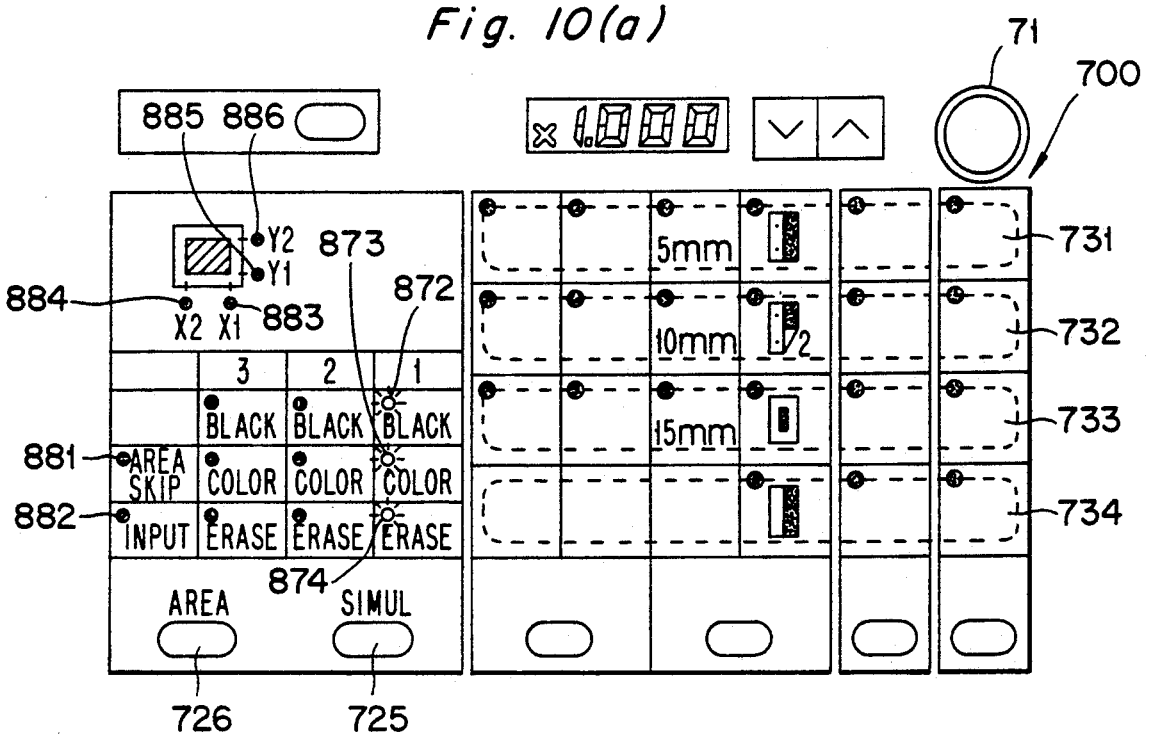
FIGS. 10(*a*) to 10(*d*) are views similar to FIG. 8, showing the sequence of how the color simulcopy mode is executed.
Figure 10B:
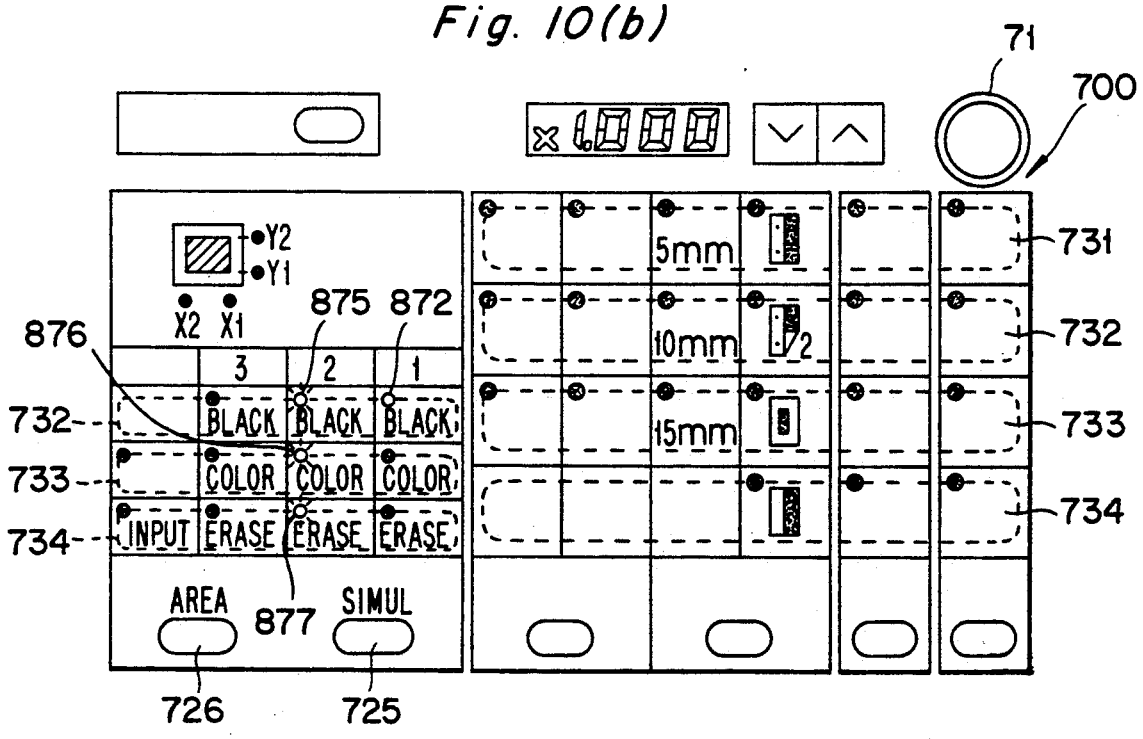
Figure 10C:
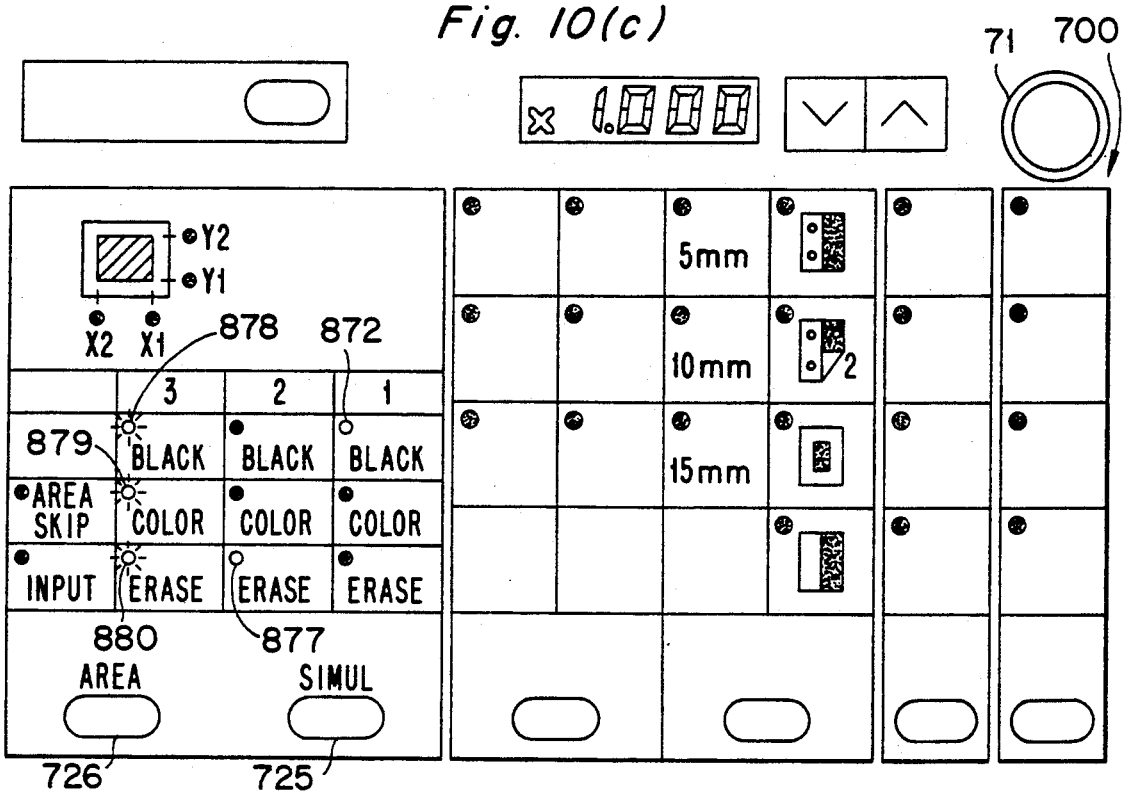
Figure 10D:
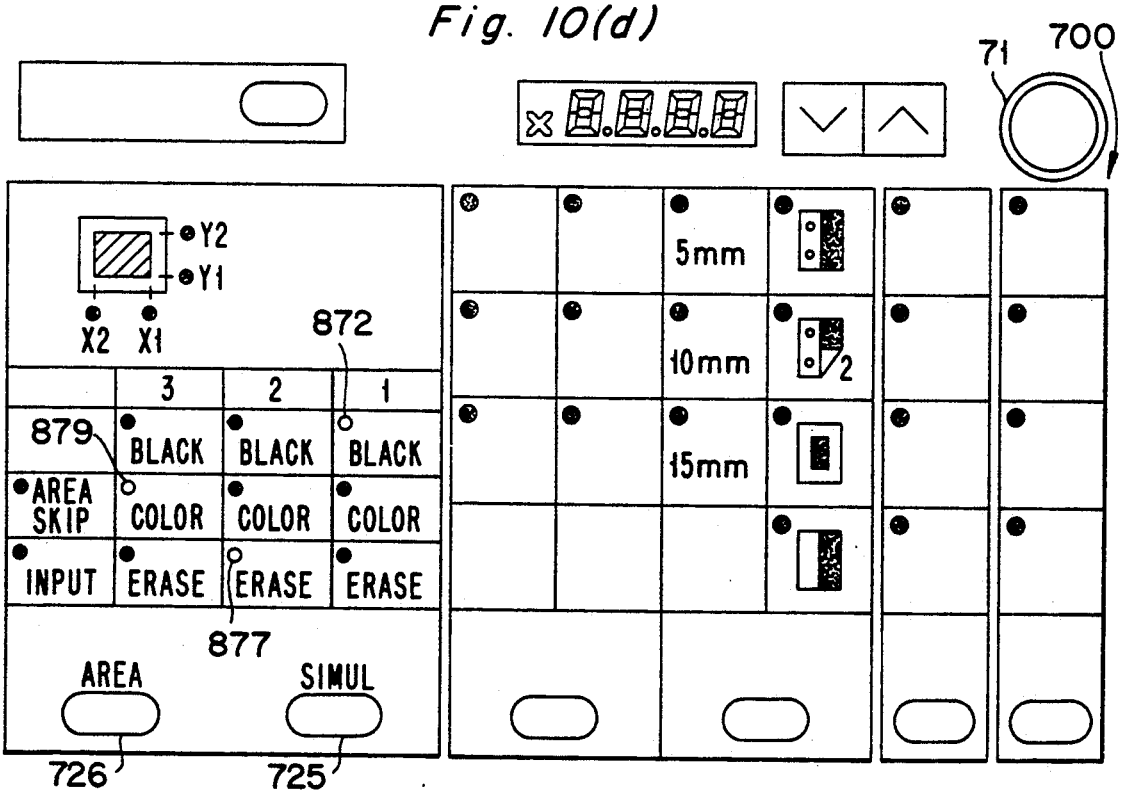

As best shown in FIGS. 1 and 7, the touch panel portion 700 includes a transparent touch panel 706, below which is disposed a hieroglyphic menu sheet 704 as shown in FIG. 9. The hieroglyphic menu sheet 704 has legends and pictorial symbols imprinted thereon in respective boxes arranged in a grid pattern of rows and columns, which legends and pictorial symbols represent respective functions available in the copying machine. At best shown in FIG. 7, boxes in each column on the hieroglyphic menu sheet 704 are allocated to the functions of the copying machine which can be categorized into a common class of function.

Specifically, the touch panel portion 700 has a plurality of, for example, five, display columns 700A, 700B, 700C, 700D and 700E of boxes defined therein and categorized to MEMORY SELECT, ZOOM INPUT, FEATURES 2, FEATURES 1 and EDIT, respectively, in the order from right to left as viewed in FIG. 7, the lowermost box in each of these display columns except for that in the leftmost display column 700E being provided with a respective menu key 721, 722, 723 or 724. In the lowermost box in the leftmost column 700E is, however, provided with two menu keys 725 and 726 which are utilized to establish the color simulcopy mode and the area edited copy mode, respectively, these menu keys 725 and 726 being hereinafter referred to as a simul edit key and an area edit key. A depression of any one of the menu keys 721 to 726 results in a selection of the associated display column. It is to be noted that any one of the keys 721 to 726 is named a "menu" key in view of the fact that each key 721 to 726 is used to select one of the functions categorized in the associated display column.

By way of example, the MEMORY SELECT key 721 in the rightmost display column 700A corresponds to a group of legends of the functions "Zoom 1", "Zoom 2", "P1" and "P2", the first two of said legends signifying the zooming magnification factors while the remaining legends signify different programs. The ZOOM INPUT key 722 in the display column 700B next to the rightmost column 700A corresponds to a group of a legend "10-key Input" for inputting a selected magnification through the ten numerical keys, a pictorial symbol representing a calculator for calculating a copying magnification, a legend "1-Time Zoom" for setting a magnification factor which may be used only one time, and a legend "Zoom Memory" for inputting the selected magnification in either one of Zoom 1 and Zoom 2.

The column for each of the menu keys 723 and 724 is divided into parallel sub-columns. Specifically, boxes in the right-hand sub-column of the display column 700C for the menu key 723 have respective pictorial symbols representing, in the order from top to bottom, respective functions of a first binding margin, a second binding margin, a frame erasure and a punch-hole erasure, whereas boxes in the left-hand sub-column of the same display column 700C for the menu key 723 have respective legends of "5 mm", "10 mm" and "15 mm" in the order from top to bottom which represent respective set amounts for the frame erasure. Since the functions in the boxes in the right-hand sub-column are subordinate to those in the boxes in the left-hand column, the boxes in the right-hand and left-hand sub-columns are arranged in side-by-side relationship with and in correspondence with each other, which are in turn associated with the same menu key 723. This is because, unless two functions are sequentially specified, no function can be set to the copying machine. However, an exception is that since the function available from the lowermost box in the right-hand sub-column is fixed to the set amount of 20 mm for the punch-hole erasure function, no subordinate function may be specified.

Functions (BLACK, COLOR, ERASE) for specifying an erasure or developing color for an area are allocated to the simul edit key 725; and functions (BLACK., COLOR, ERASE) for specifying an erasure or developing color for an area and functions (INPUT, AREA SKIP) for specifying the position of the area on the coordinate system are allocated to the area edit key 726. In other words, the function for specifying the developing color are concurrently utilized during the simul color copy mode and also during the area edited copy mode. It is to be noted that the legends BLACK, COLOR and ERASE are functions used for effecting a black development, a color development and an erasure without development, respectively.

FIG. 7 illustrates the arrangement of selection keys 731 to 734 in addition to the menu keys 721 to 726 on the touch panel portion 700. For example, the selection key 731 is provided in each of the six uppermost boxes in the respective columns associated with the menu keys 721, 722, 723 and 724. The other selection keys 732 to 734 are similarly arranged as shown in FIG. 7. The transparent touch panel 706 includes the selection keys 731 to 734, each of said selection keys 731 to 734 being in the form of a transparent membrane panel switch that can be brought into an electrically conductive state when touched by a finger of the operator of the copying machine.

Figure 8:
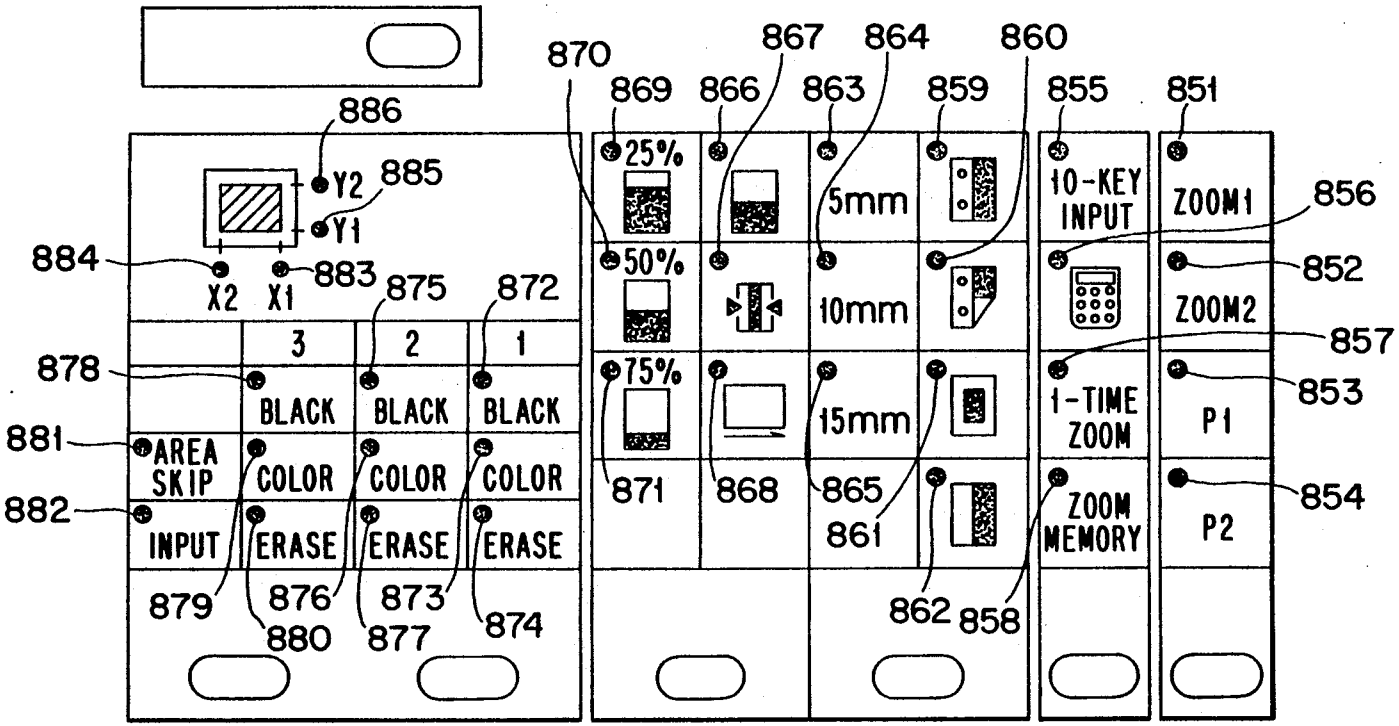
FIG. 8 is a fragmentary plan view of the control panel showing an arrangement of light emitting diodes for back lighting.

As indicated by a black circle in FIG. 8, arrangement has been made so that light emitted from each of light emitting diodes 851 to 886 for back lighting can be visible at a top left corner of each box in which the corresponding legend or pictorial symbol is imprinted for signifying the associated function. Each light emitting diode can blink to invite the operator of the copying machine to select the respective function represented by such light emitting diode, and should such function selected, such light emitting diode can be lit.

(In the drawing, the black circle signifies that the corresponding light emitting diode has not been lit.)

FIG. 8 also illustrates the arrangement of LED (light emitting diode) backlighting disposed beneath the touch panel portion 700 and legends and pictorial symbols imprinted on the hieroglyphic menu sheet 704 in correspondence with such light emitting diodes. The light emitting diode 851 to 886 can be lit independently of each other.

FIG. 9 illustrates the structure of the touch panel portion 700. This touch panel portion 700 includes a printed circuit board 702 on which the backlighting light emitting diodes 851 to 886 are mounted and are divided for the associated blocks. The touch panel portion 700 also includes the hieroglyphic menu sheet 704 positioned above the printed circuit board 702 and the transparent touch panel 706 laid over the hieroglyphic menu sheet 704. It is to be noted that in the menu keys 721 to 726 key-topped key switches are arranged separately from the above described structure.

As shown in FIGS. 8 and 9, arrangement has been made that, as shown by the circles in the top left corner of the boxes each bearing the legend or pictorial symbol representative of the associated function, light from the light emitting diodes 851 to 886 can be visible. However, an alternative arrangement is possible that, provided that the legends and the pictorial symbols imprinted on the hieroglyphic menu sheet 704 are made transparent while the background is colored opaque, each backlighting light emitting diode 851 to 886 may be used to illuminate the associated legend or pictorial symbol. This can be equally accomplished even if the legends and the pictorial symbols are made opaque while the background is made transparent.

(d) Specification of Function

Each of various copying functions can be specified by a combination of one of the menu keys 721 to 726 with one of the selection keys 731 to 734. As discussed hereinbefore, the menu keys 721 to 726 are assigned the respective functions represented by groups of the legends or pictorial symbols. By way of example, the MEMORY SELECT key 721 is assigned the two magnification factors (Zoom 1 and Zoom 2) and the two programs (Pl and P2). Similarly, the ZOOM INPUT key 722 is assigned the four functions. Each of the FEATURE 2 and FEATURE 1 keys 723 and 724 is assigned the functions allocated to each of the two sub-columns.

Specifically, the FEATURE 2 key 723 is assigned a group of the functions of BINDING MARGIN 1, BINDING MARGIN 2, FRAME ERASURE and PUNCH-HOLE ERASURE in the right-hand sub-column and a group of the functions of 5 mm, 10 mm and 15 mm in the left-hand sub-column. The functions allocated to the left-hand sub-column of the FEATURE 2 key 723 are associated with the top three functions in the right-hand sub-column of the FEATURE 2 key 723 that, when one of the functions in the right-hand sub-column is selected, one of the functions in the left-hand sub-column needs to be necessarily selected. Thus, a combination of one of the functions in the right-hand sub-column with one of the functions in the left-hand sub-column forms an entire function to be performed by the copying machine. This equally applies to the FEATURE 1 key 724.

As hereinbefore described, the simul edit key 725 for the color simulcopy is assigned the color specifying functions (BLACK, COLOR and ERASE) and the area edit key 725 for the area edited copy is assigned the color specifying functions (BLACK, COLOR and ERASE) and the functions INPUT, and AREA SKIP) for the specification of an image editing area. The former and latter functions cannot be specified simultaneously. The latter INPUT function is associated with light emitting diodes 883 to 886 for the display of the position on the coordinate system and the ten numerical keys 80 to 89 for inputting values representative of the position on the coordinate system.

The selection of a particular one of the functions can be accomplished by sequentially depressing one of the menu keys to which such particular one of the functions belongs and an associated one of the selection keys. Examples of procedures for the selection of the color simulcopy mode and the simultaneous editing and those for the selection of the area edited copy mode and the area editing will now be described with particular reference to FIGS. 10(*a*) to 10(*d*).

It is assumed that the division of the document to be copied into the three areas, that is, AREA I, AREA II and AREA III in a direction parallel to the scanning direction for the purpose of the simultaneous color copying has been done by positioning the slide levers 101 and 102 of the position specifying mechanism 100 shown in and described with reference to FIG. 5.

When and so long as the copying machine is in an initial condition, as shown in FIG. 10(*a*), only the print key 71 and the magnification display 76 are lit in a green color at the touch panel portion 700. Assuming that of the menu keys the simul edit key 725 is depressed, the light emitting diodes 872 to 874 associated with the three functions (BLACK, COLOR and ERASE) in the vertical column associated with the copying of the AREA I blink in a green color inviting the operator of the copying machine to choose one of these functions. At the same time, the print key 71 is lit in a red color.

On the other hand, although not shown, when the area edit key 726 is depressed while the copying machine is in the initial state, a light emitting diode 882 associated with INPUT for inputting the coordinates of the AREA I and an light emitting diode 881 associated with AREA SKIP for skipping the setting of the coordinates of the AREA I blink. If the selection key 734 is at this time depressed, a coordinate input mode is established and, for inviting the operator of the copying machine to input the coordinates Xl of the AREA I, a light emitting diode 883 blinks (See FIG. 20). This inputting of the coordinates Xl can be accomplished by sequentially depressing some of the ten numerical keys 80 to 89. After the coordinates Xl have been inputted, the light emitting diode 883 once having blinked is lit, indicating the completion of the inputting of the coordinates X1. Subsequently, the light emitting diode 884 then blinking is lit. In this way, the inputting of coordinates Y1 and Y2 is carried out (See FIGS. 22(*a*) and 22(*b*)). After the setting of the coordinates for the AREA I, a developing color for the AREA I as will be described later is to be specified and, when the developing color for the AREA I has been specified, the light emitting diodes 881 and 882 blink again to invite the operator of the copying machine to either set coordinates for the AREA II or skip it. The setting of the coordinates for the AREA II is carried out in a manner similar to the setting of the coordinates for the AREA I. After the setting of the coordinates for the AREA II has been completed, a developing color for the AREA II is to be specified. With respect to the AREA III, no setting of coordinates for the AREA III is carried out since the AREA III corresponds to an area of the document from which both of the AREAs I and II are subtracted. It is to be noted that, where AREA SKIP is selected for each of the AREAs I and II, no specification of the corresponding developing color need be carried out and, so far as the illustrated embodiment is concerned, the development is carried in a standard color, that is, black.

As shown in FIGS. 10(*a*) to 10(*d*), when and after the setting of the coordinates for the AREA I has been completed, the light emitting diodes 872 to 874 associated with the functions (BLACK, COLOR and ERASE) in the column associated with the copying of a portion of the document falling in the AREA I blink in a green color. After the setting of the coordinates for the AREA II, the light emitting diodes 875 to 877 blink and, after the specification of the developing color for the AREA II, the light emitting diode 878 to 880 blink in a green color to invite the operator of the copying machine to select one of the three functions. The print key 71 is kept lit in a red color until the setting of the coordinates of the areas and the specification of the developing color are completed.

Hereinafter, the operation for specifying the developing color for each of the areas will be described. It is, however, to be noted that the color specifying operation hereinafter described is equally carried out during any one of the simulcopy mode and the area edited copy mode.

When the selection key 732 for the selection of BLACK is depressed, of the light emitting diodes then blinking only the light emitting diode 872 is, as shown in FIG. 10(*b*), lit in a green color while the remaining light emitting diodes are turned off. At the same time, the light emitting diodes 875 to 877 associated with the functions (BLACK, COLOR and ERASE) in the column corresponding to the AREA II blink in a green color to invite the operator of the copying machine to select one of the functions. It is to be noted that, when the selection key 732 is to be depressed, it is not always necessary to depress top of the legend of BLACK. Although not shown, in the case of the area edited copy mode, the light emitting diodes 881 and 882 blink for the setting of the coordinates for the AREA II, asking the operator either to input the coordinates for the AREA II or to skip it. Once the coordinates for the AREA II have been set, a specification of the developing color for the AREA II takes place.

When the selection key 734 is subsequently depressed for the selection of ERASE, of the light emitting diodes then blinking only the light emitting diode 877 representative of ERASE is lit in a green color while the remaining light emitting diodes are turned off. At the same time, the light emitting diodes 878 to 880 associated with the functions (BLACK, COLOR and ERASE) in the column corresponding to the AREA III blink in a green color, asking the operator to select one of the functions.

If thereafter the selection key 733 is depressed for the selection of COLOR, of the light emitting diodes then blinking only the light emitting diode 879 representative of COLOR is lit in a green color while the remaining light emitting diodes are turned off. After all, BLACK, ERASE and COLOR are specified to the AREAs I, II and III, respectively, and, therefore, the light emitting diodes 872, 877 and 879 are kept lit in a green color, providing a visual indication that the functions BLACK, ERASE and COLOR have been selected for the AREAs I, II and III, respectively. Even in this case, the selection key 733 may be depressed at any position.

In this way, all necessary settings have been completed and the print key 71 is lit again in a green color.

It is to be noted that the setting of any one of the functions associated with the FEATURE 1 key 724, the FEATURE 2 key 723 and the ZOOM INPUT key 722 have no concern with the present invention and, therefore, the details thereof will not be herein made for the sake of brevity.

(e) Structure of Control of Copying Machine

Figure 11:
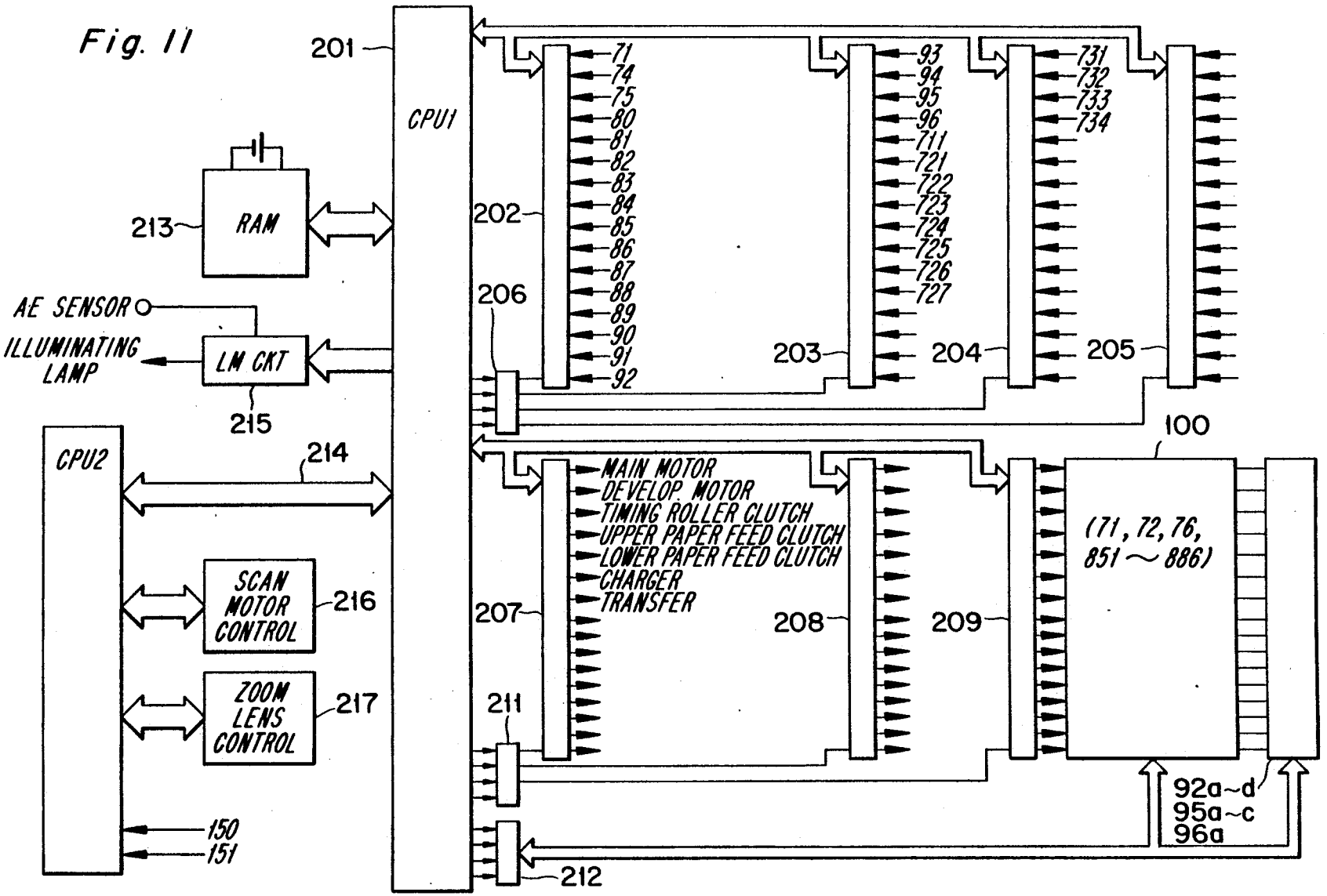
FIG. 11 is a schematic circuit block diagram showing an electric control system used in the copying machine embodying the present invention.
Figure 12A:
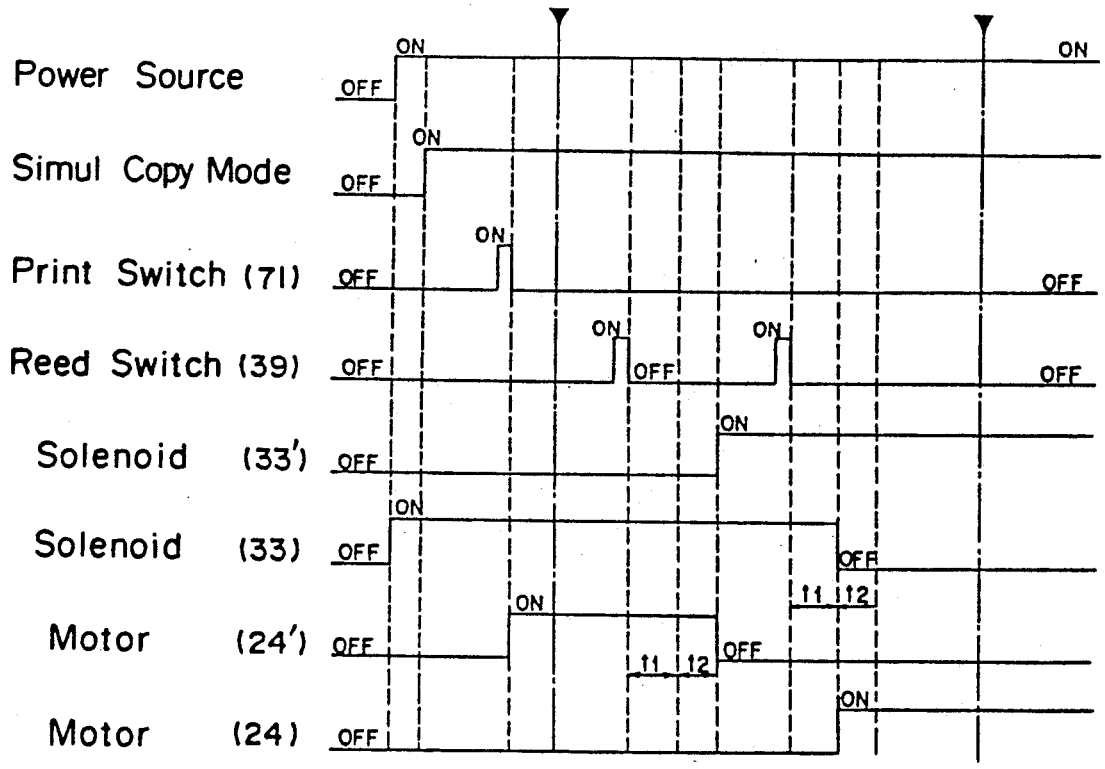
FIGS. 12(*a*) to 12(*d*) are timing charts showing the timed relationship of various component parts of the copying machine during the execution of the color simulcopy mode.
Figure 12B:
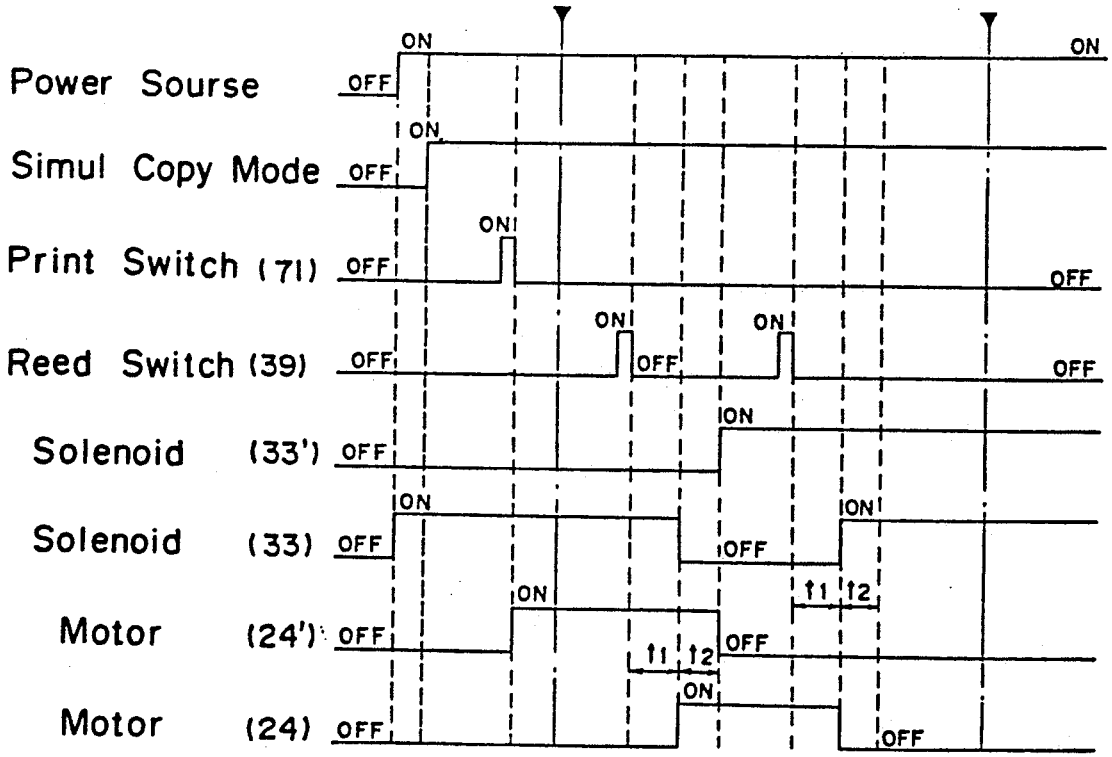
Figure 12C:
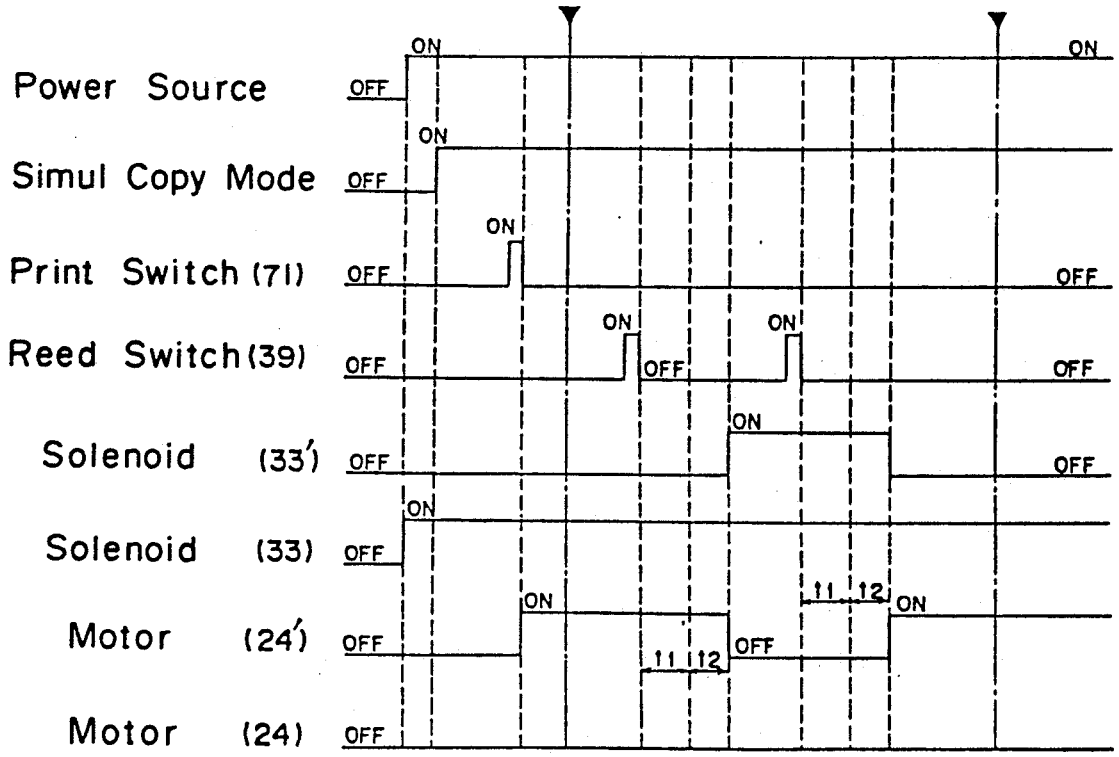
Figure 12D:
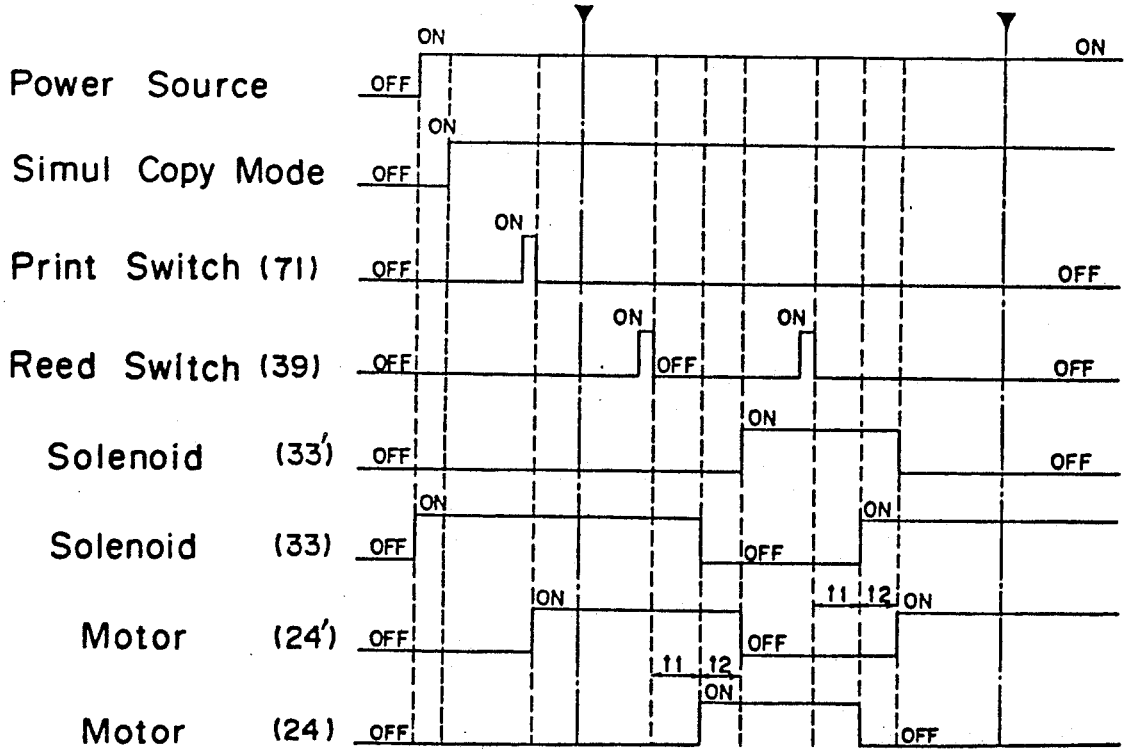

Input and output connections in relation to a central processing unit (CPUl) 201 used to control the sequence of operation of the copying machine are shown in FIG. 11. Integrated circuits 202 to 205 and 207 to 209 are IC devices for use in- expanding the input and output facilities, such as identified by 8243 of Intel Corp. Of them, the integrated circuits 202 to 205 are used as input IC devices and are connected with CPUl through data lines. The integrated circuits 202 to 205 are controlled by CPUl by means of a decoder 206 and have input terminals connected with the various keys and displays. The integrated circuits 207 to 209 are used as output IC devices, whose control boards are connected with CPUl through a decoder 211. These integrated circuits 207 to 209 have output terminals connected with various component parts as shown, a light emitting diode matrix 100 (display light emitting diodes 71, 72, 76 and 851 to 886) and light emitting diodes 92*a* to 92*d*, 95*a* to 95*c* and 96*a* and are adapted to be controlled by CPU1 by means of a decoder 212. A random access memory (RAM) 213 is connected with CPUl and is backed up by a battery. A bus 214 represents a transmission line for connecting CPUl with another central processing unit (CPU2). CPU1 transmits to a light measuring circuit (LM CKT) 215, as a data, a selected one of 9-step exposure values during a manual exposure or a value which will become a center of an automatic exposure during an automatic exposure.

Input and output ports of CPU2 used to control an optical system are connected with a scan motor control circuit 216 for controlling a scan motor and a zoom lens control circuit 217 for controlling a motor used to move a projecting lens 16. This CPU2 is inputted with a signal from a fixed position switch 150 and, also, a signal from a switch 151 for generating a timing signal used to drive a timing roller 26 during an equal-magnification copying.

(f) Machine Operation During Color Simulcopy Mode

FIGS. 12(*a*) to 12(*d*) illustrate respective timing charts applicable during the color simulcopy mode, these timing charts being associated respectively with the simultaneous color copying of black→erasure→color, black→color→erasure, black→erasure→black, and black→color→black.

Hereinafter, a control operation will be described with reference to these timing charts shown in FIGS. 10(*a*) to 10(*d*).

When a main switch (not shown) of the copying machine is turned on to power the machine on, a portion intermediate between the magnetic poles $N_1$ and $S_1$ in the first developing unit 4 confronts the photoreceptor drum 1 at the first developing station X and the magnetic pole $N_1$ in the second developing unit 5 confronts the photoreceptor drum at the second developing station X'.

When the simul edit key 725 is depressed during this condition, a simultaneous editing mode is established. However, when the setting of the simultaneous editing mode has been completed, a copying mode can be altered from a normal copying to the color simulcopy mode.

Thereafter, the first and second slide levers 101 and 102 of the position specifying mechanism 100 have to be moved along the slide groove 103 to specify respective AREAs I, II and III at which black development, erasure and color development are to be carried out. It is to be noted that the first and second slide levers 101 and 102 are valid only during the color simulcopy mode and cannot perform any function when manipulated during the other mode than the color simulcopy mode.

After the machine is so conditioned as hereinabove described, and when the print switch 71 is turned on subsequent to the placement of the document S on the transparent document support 9, the developing motor 24' for the second developing unit 5 is driven to drive the developing sleeve 12', the supply roll 14, and the screw feeder 15' in the respective directions shown by the arrows b, c and d.

Consequent upon the rotation of the screw feeder 15', the supply roll 14' and the developing sleeve 12', the developing material containing black toner within the developer tank 11' is circulated through the delivery passages 16' and 17' while mixed and stirred by the rotation of the supply roll 14' and the screw feeder 15' and is in part supplied by the supply roll 14, onto the outer peripheral surface of the developing sleeve 12' thereby forming a magnetic brush on the outer peripheral surface of the developing sleeve 12'.

The magnetic brush so formed is regulated in height by the bristle height regulating member 19' during the continued rotation of the developing sleeve 12' as it pass through the bristle height regulating gap Db and is subsequently delivered onto the developing station X' so that the electrostatic latent image on the photoreceptor 1 can be set in a position ready to be developed.

With the print switch 71 turned on, the scanner 40 starts its scanning motion in the direction shown by the arrow b with the document S on the transparent document support 9 illuminated. Imagewise rays of light reflected from the document S are projected onto the photosensitive surface of the photoreceptor drum 1 at the exposure station W to form a electrostatic latent image which is subsequently developed by the second developing unit 5.

When the magnet piece 101*a* fast with the first slide lever 101 is detected by the reed switch 39 carried by the scanner 40 during the scanning motion of the scanner 40, the reed switch 39 supplies a signal indicative of the detection of the magnet piece 101*a* to a control device.

It is to be noted that a portion of the electrostatic latent image corresponding to the boundary Z1 between the AREAs I and II at which the black development is switched onto the erasure lies at the exposure point W on the photoreceptor drum 1 and, during a length of time equal to the sum of the time tl required for this boundary Z1 to move from the exposure station W to the first developing station X for the first developing unit 4 and the time t2 required for the boundary Z1 to move from the first developing station X to the second developing station X', only the second developing unit 5 is continued to operate.

The magnet piece 102*a* fast with the second slide lever 102 of the position specifying mechanism 100 is subsequently detected by the reed switch 39 carried by the scanner 40 and, at this moment, the boundary Z2 between the AREAs II and III at which the erasure is switched onto the color development lies at the exposure station W and, during a length of time equal to the time tl required for the boundary Z2 to move from the exposure station W to the first developing station X for the first developing unit 4, both of the first and second developing units 4 and 5 are held in inoperative position. Because of this, a portion corresponding to the AREA II between the boundaries Z1 and Z2 can be erased.

After the passage of the time tl subsequent to the second switching on of the reed switch 39, and when the boundary Z2 of the electrostatic latent image arrives at the developing station X, the first developing motor 24 is turned on and the solenoid unit 33 associated with the first developing unit 4 is turned off.

Thereby, the first developing unit 4 is set in a position similar to the second developing unit 5 and the developing sleeve 12, the supply roll 14 and the screw feeder 15 are driven in the respective directions shown by the arrows b, c and d with a magnetic brush consequently formed on the outer peripheral surface of the developing sleeve 12 in readiness for the development of the electrostatic latent image on the photosensitive surface of the photoreceptor drum 1. Thus, by the operation of the first developing unit 4, an operation to supply a color toner onto a portion of the electrostatic latent image corresponding to the AREA III is initiated. This operation continues until the end of the scanning motion of the scanner 40, with the color development of the AREA III subsequently finalized.

By the foregoing procedures, during a period from the start of the scanning motion to the end of the scanning motion, the simultaneous color copy can be obtained in which the developing color is switched from black, erasure and color.

A similar description is applicable to the simultaneous color copying of black→color→erasure, black→erasure→black, and black→color→black. Specifically, as shown by the respective timing charts shown in FIGS. 12(*a*) to 12(*d*), the simultaneous color copying of black→color→erase, black→erasure→black, and black→color→black can be accomplished by switching the ON/OFF states of the motors 24 and 24' for the first and second developing units 4 and 5 and the first and second solenoid units 33 and 33' for the first and second developing units 4 and 5.

(g) Operation of Copying Machine

Summaries of contents of the programs stored in CPU1 used to control the copying machine will now be described. It is to be noted that the term "On-edge" used in the description that follows is intended to mean a change of any switch, sensor or signal from an OFF state to an ON state and, similarly, the term "Off-edge" is intended to mean a change of such switch, sensor or signal from the OFF state to the ON state.

(g-1) Main Routine

Figure 13:
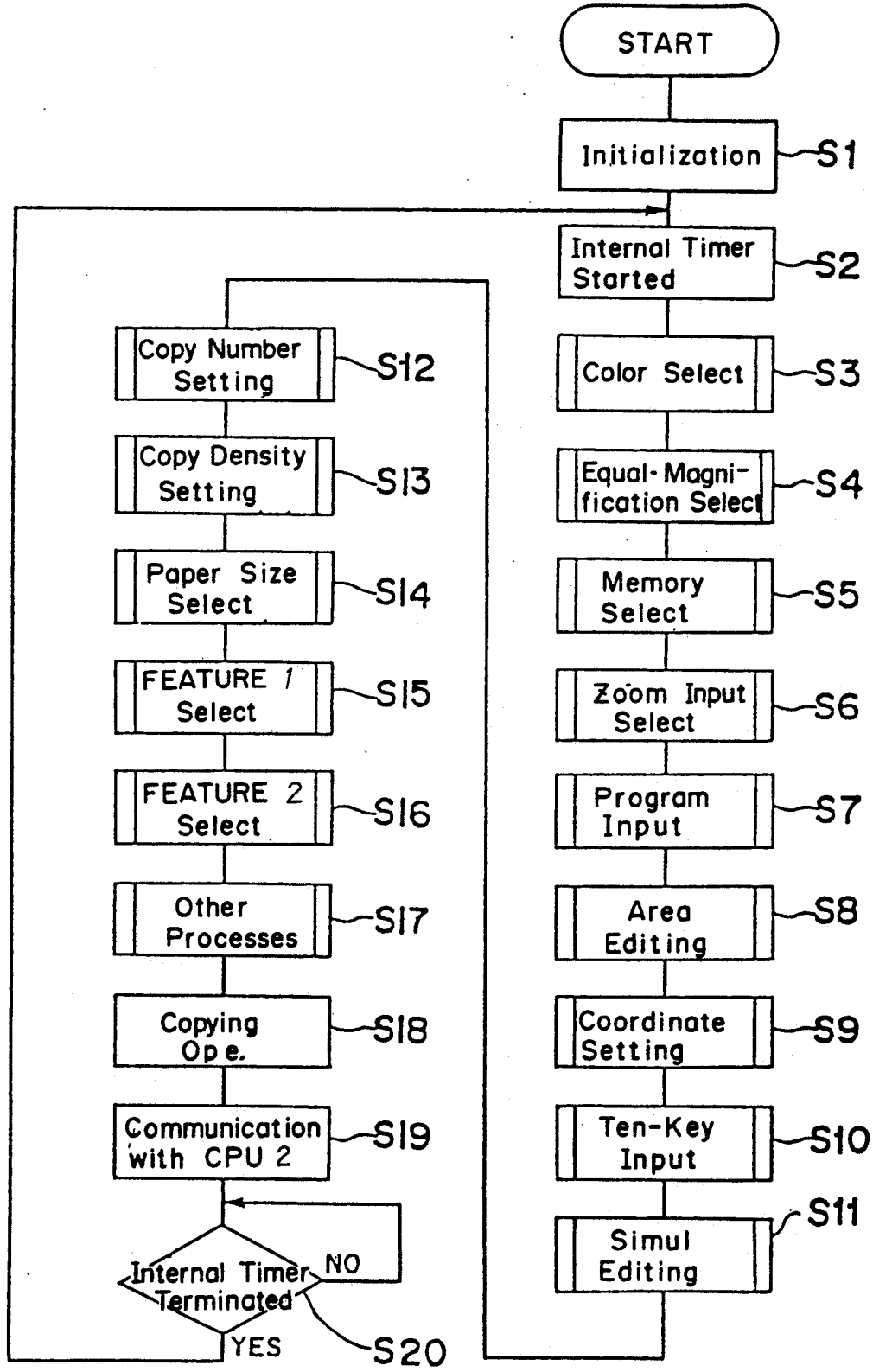
FIG. 13 is a flowchart showing a main routine of control of the copying machine.

A schematic flowchart showing the sequence of operation of CPU1 is shown in FIG. 13. When CPU1 is reset with the program started consequently, an initialization is carried out at step S1 wherein the random access memory (RAM) is cleared, various registers are reset to initial states, CPUl is initialized and devices are set to initial conditions.

At subsequent step S2, an internal timer built in CPU1, the value of which has been set during the initialization, is started. Thereafter, various processing subroutines including a color select routine (step S3), an equal-magnification select routine (step S4), a memory select routine (step S5), a zoom input routine (step S6), a program input routine (step S7), an area editing routine (step S8), a coordinate setting routine (step S9), a ten-key input routine (step S10), a simul edit routine (step S11), a copy number setting routine (step S12), a copy density setting routine (step S13), a paper size select routine (step S14), a FEATURE 1 select routine (step S15), a FEATURE 2 select routine (step S16), and other process routines (step S17) are sequentially carried out, followed by a copying, operation at step S18. Thereafter, data communication with CPU2 is carried out at step S19.

After the execution of all of the subroutines, and after the passage of the preset time set in the internal timer (as determined at a decision step S20), the complete routine is terminated with the program flow return to step S2. By utilizing the length of time required to complete this routine, counting of various timers that show up in the respective subroutines is carried out. (It is to be noted that the preset time set in each of these timers is so chosen that the termination of the preset time can be determined depending on how often this complete routine is repeated.)

(g-2) Color Select

Figure 14:
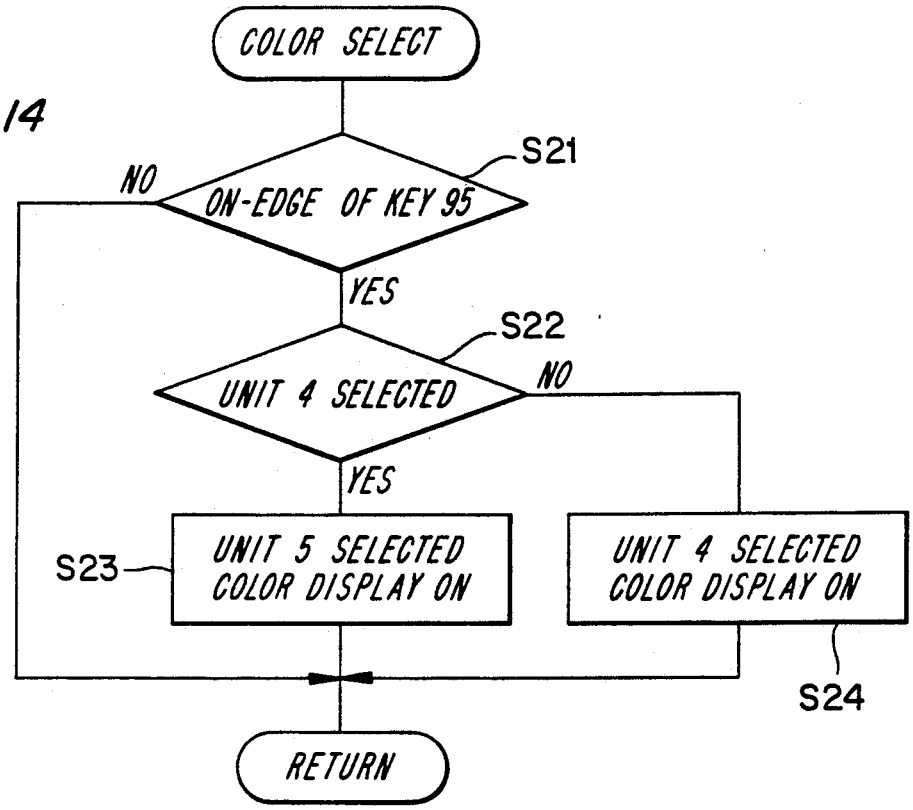
FIG. 14 to 21 are flowcharts showing respective subroutines employed during the execution of the main routine shown in FIG. 13.

The details of the color select subroutine executed at step S3 of the routine of FIG. 13 are shown in FIG. 14. If the color select key 95 is in the On-edge as determined at step S21 and the first developing unit 4 is selected as determined at step S22, the second developing unit 5 is selected at step S23 and the color of the second developing unit 5 is displayed at step S23. On the other hand, if the first developing unit 4 is not selected as determined at step S22 and, hence, the second developing unit 5 is selected, the first developing unit 4 is selected and the color of the first developing unit 4 is displayed at step S24.

(g-3) Equal-Magnification Select

Figure 15:
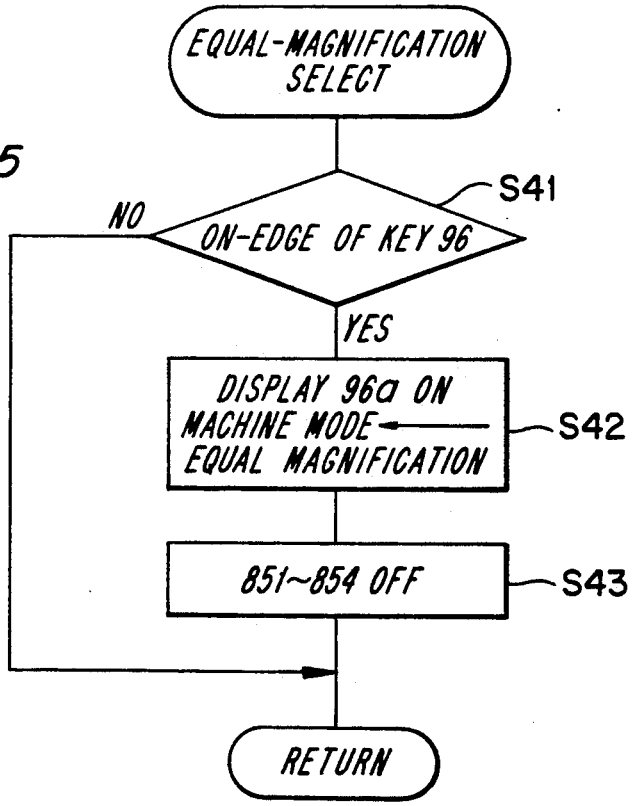

The details of the equal-magnification select subroutine executed at step S4 of the routine of FIG. 13 is shown in FIG. 15. When the equal-magnification select key 96 is depressed at step S41, the equal-magnification select display 96*a* is lit and the machine is set to an equal-magnification mode in such a way as to move the lens 16 to an equal-magnification position at step S42. Then, the light emitting diodes 851 to 854 representative of Zoom 1, Zoom 2, P1 and P2 are turned off at subsequent step S43.

(g-4) Memory Select

Figure 16:
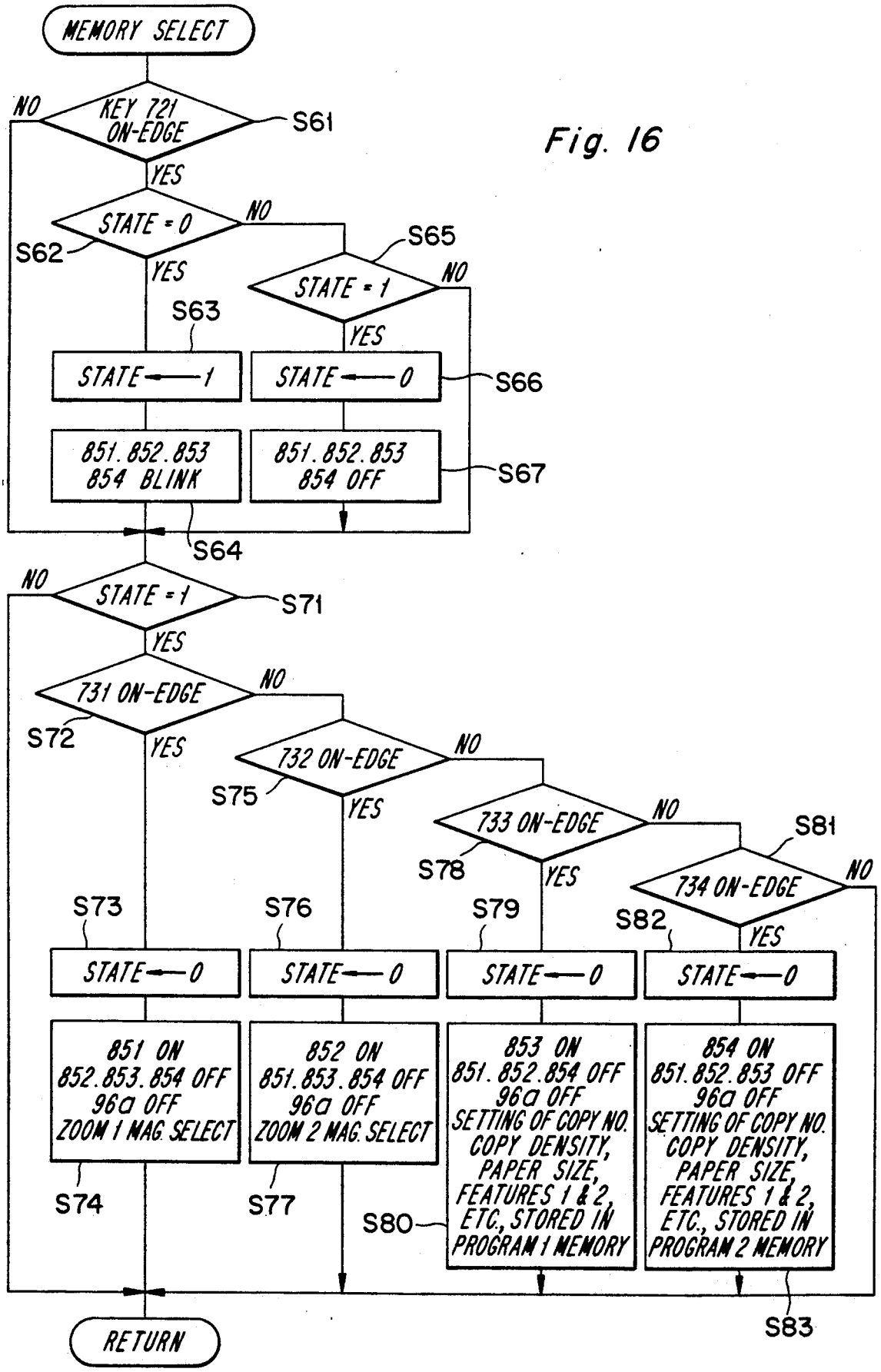

The details of the memory select subroutine executed at step S5 of the routine of FIG. 13 are shown in FIG. 16. When the MEMORY SELECT key 721 is depressed at step S61 and if a state is 0 (indicated by "YES" at step S62), that is, the state is rendered to be 1 at step S63 during a stand-by condition, the light emitting diodes 851 to 854 start blinking at step S64. When the state is 1 (as indicated by "YES" at step S65), that is, during the blinking of the light emitting diodes 851 to 854, the state is rendered to be 0 step S66, and the light emitting diodes 851 to 854 are turned off to terminate the blinking at step S67. When the state is 1 as determined at step S71 and the selection key 731 is depressed as indicated by "YES" at step S72, the state is rendered to be 0 at step S73 and, at subsequent step S74, only the light emitting diode 751 is lit while the light emitting diodes 852 to 854 as well as the equal-magnification display 96*a* are turned off, thereby indicating that Zoom 1 has been selected and operations including the movement of the lens are carried out so that copying can be accomplished at a magnification stored in a zoom memory. Similarly, when the selection keys 732, 733 and 734 are depressed (as indicated by "YES" at steps S75, S78 and S81), the state is rendered to be 0 at steps S76, S79 and S82 and Zoom 2, Pl and P2 are selected at steps S77, S80 and S83, respectively.

Figure 18:
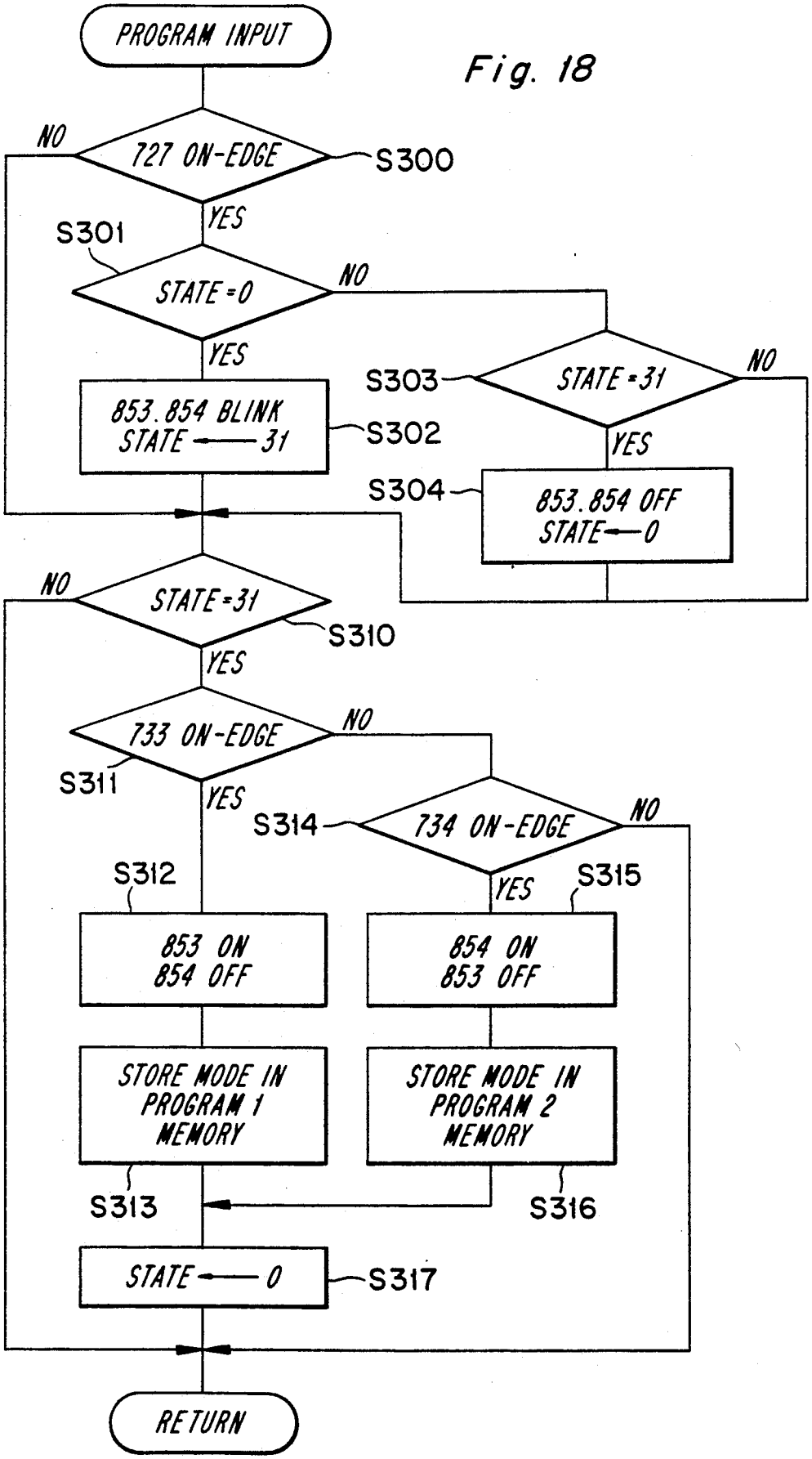

P1 and P2 are used for calling for all mode information associated with the copying operation and stored in a memory according to the program input subroutine shown in FIG. 18 so that the copying can be accomplished under such mode.

Where, for example, only the setting of a copying magnification factor is desired to be changed to the copying magnification registered in Zoom 1 or Zoom 2 subsequent to the selection of P1 or P2 (at this time, the state is rendered to be 0 at steps S79 and S82), only the function of the copying magnification from all mode information associated with the copying and stored by P1 or P2 can be altered (at step S74 or S77) by depressing the MEMORY SELECT key 721 again at step S61 to establish the memory select mode (to render the state to be 1 at step S63) and then by depressing the selection key 731 at step S72 if the magnification factor of Zoom 1 is to be selected or the selection key 732 at step S75 if the magnification factor of Zoom 2 is to be selected. This is possible because, as can be understood from the routine of FIG. 13, the memory select routine (step S5) is repeated.

(g-5) Zoom Input

Figure 17A:
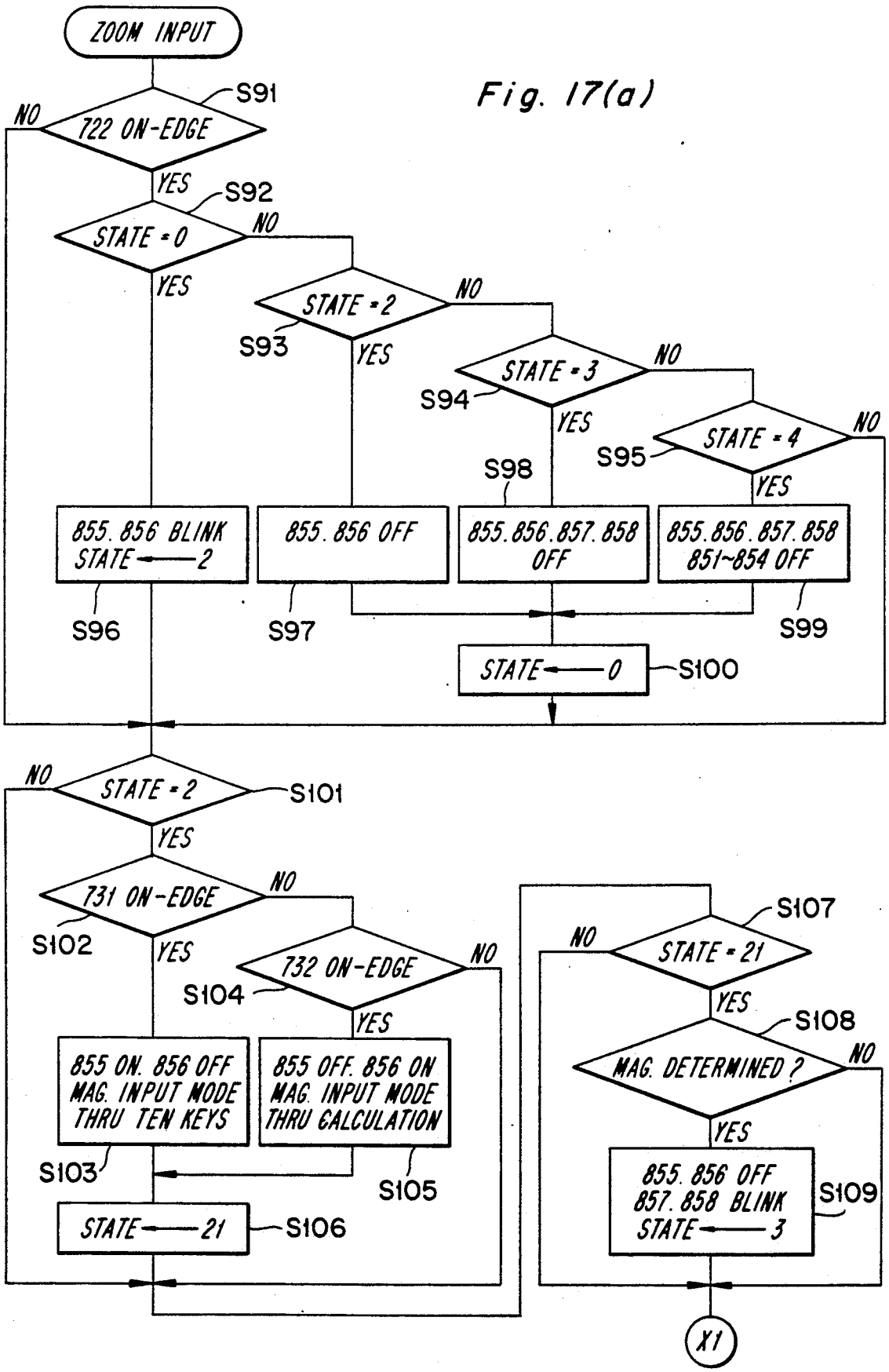

FIGS. 17(*a*) and 17(*b*) illustrates the zoom input subroutine executed at step S6 of the routine of FIG. 13.

When the ZOOM INPUT key 722 is depressed as determined at step S91, and if the state is 0 as determined at subsequent step S92, the light emitting diodes 855 and 856 start blinking and the state is then rendered to be 2 at step S96, that is, a mode is established in which either the magnification factor is inputted through the ten numerical keys 80 to 89 or a calculation is performed. When the state is any one of 2, 3 and 4 (steps S93, S94 and S95, respectively), the associated displays are turned off according to the respective states (steps S97, S98 and S99, respectively), followed by the establishment of a stand-by condition at step S100.

Referring first to FIG. 17(*a*), when the state is 2, that is, the input mode (the ten numerical keys or the calculation) is waited for, as indicated at step S101, and when the selection key 731 is subsequently depressed at step S102, the light emitting diode 855 is lit while the light emitting diode 856 is turned off, thus establishing the magnification input mode at step S103 by means of the ten numerical keys. Also, when the selection key 732 is depressed at step S104, the light emitting diodes 855 and 856 are turned off and lit, respectively, thus establishing the input mode at step S105 by means of the calculation. While the procedure associated with the calculation will not be herein discussed, there may be provided keys for the calculation or any other keys may be used for the calculation by switching according to the function.

Thereafter, the state is rendered to be 21 at step S106. Where the state is 21 as determined at step S107 which signifies that the magnification input mode is established, a decision is made at step S108 to determine if the magnification has been fixed by means of the ten numerical keys or the calculation. Should the result of decision at step S108 indicate that the magnification has been fixed, the light emitting diodes 855 and 856 are turned off and the light emitting diodes 857 and 858 blink and the state is rendered to be 3 at step S109.

Referring now to FIG. 17(*b*) showing the flow continued from the flow of FIG. 17(*a*), where the state is 3 as determined at step S111, and when the selection key 733 is subsequently depressed at step S112, the function of 1-Time Zoom is specified. This 1-Time Zoom function is a function that is used to make a single copy at a magnification which has been inputted, but is not stored in the memory. After the light emitting diodes 857 and 858 are lit and turned off, respectively, at step S113, the magnification which has been inputted at the same time is corrected to a value within the magnifying capacity (for example, x0.610 to x1.640) of the copying machine and an operation (such as a movement of the lens) necessary to set the machine in a mode in which the value within the magnifying capacity of the machine is selected is carried out at step S114. On the other hand, since the depression of the selection key 734 at step S115 means the mode in which storage is effected to the memory of Zoom 1 and Zoom 2 and, therefore, the light emitting diodes 857 and 858 are turned off and lit, respectively, at step S116. Thereafter, the state is rendered to be 4 and the light emitting diodes 851 and 852 blink at step S117.

When the selection key 731 is depressed at step S122 while the state is 4 (Zoom memory storage mode) as determined at step S121, the light emitting diode (Zoom 1) 851 and the light emitting diode 852 are lit and turned off, respectively. Also, the light emitting diodes 855 to 858 are turned off and the inputted magnification is corrected to a value within the magnifying capacity of the copying machine at step S127 or the mode of the copying machine is set to such magnification mode. Further, at step S128, the magnification is stored in the memory for Zoom 1. When the selection key 732 is depressed at step S123 similar procedures take place at step S129.

(g-6) Program Input

The details of the program input routine executed at step S7 of the routine of FIG. 13 is shown in FIG. 18.

When the program input key 727 is depressed as determined at step S300, a decision is made at step S301 to determine if it is in a stand-by condition, that is, if the state is 0. If the state is 0 as determined at step S301, the light emitting diodes 853 and 854 start blinking and the state is rendered to be 31 indicative of the program input mode at step S302, followed by a decision step at S310. If the state is not 0, but 31 indicating the program input mode (indicated by "NO" at step S303), the light emitting diodes 853 and 854 are turned off and the state is rendered to be 0 at step S304, followed by the decision step at S310. Should the key 727 not be depressed as determined at step S300, or should the state be neither 0 nor 31 as determined at respective steps S301 and S303, the program flow proceeds to the decision step S310.

At step S310, a decision is made to determine if the state is 31. If the state is 31 as determined at step S310 signifying the program input mode, the subsequent depression of the selection key 733 at step S311 causes the light emitting diodes 853 and 854 to be lit and turned off, respectively, at step S312, followed by the storage of the mode, then established, in the program 1 (P1) memory at step S313. After step S313, the state is rendered to be 0 at step S317, followed by the return of the flow. Where the selection key 734 is depressed as determined at step S314, the light emitting diodes 854 and 853 are lit and turned off, respectively, at step S315, followed by the storage of the established mode in the program 2 (P2) memory at step S316. Thereafter, the program flow returns after the state has been rendered to be 0 at step S317.

(g-7) Area Editing

Figure 19A:
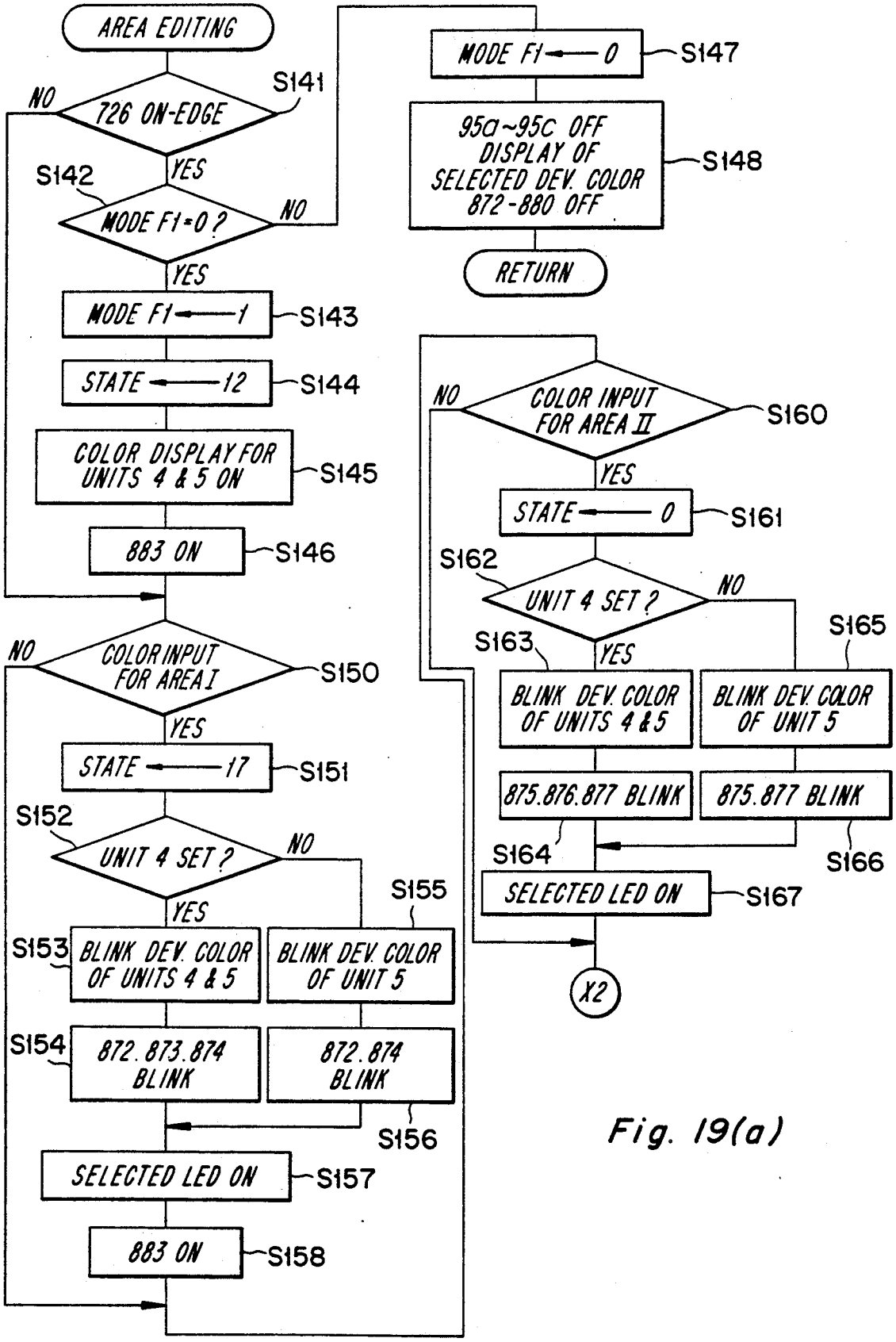
Figure 19B:
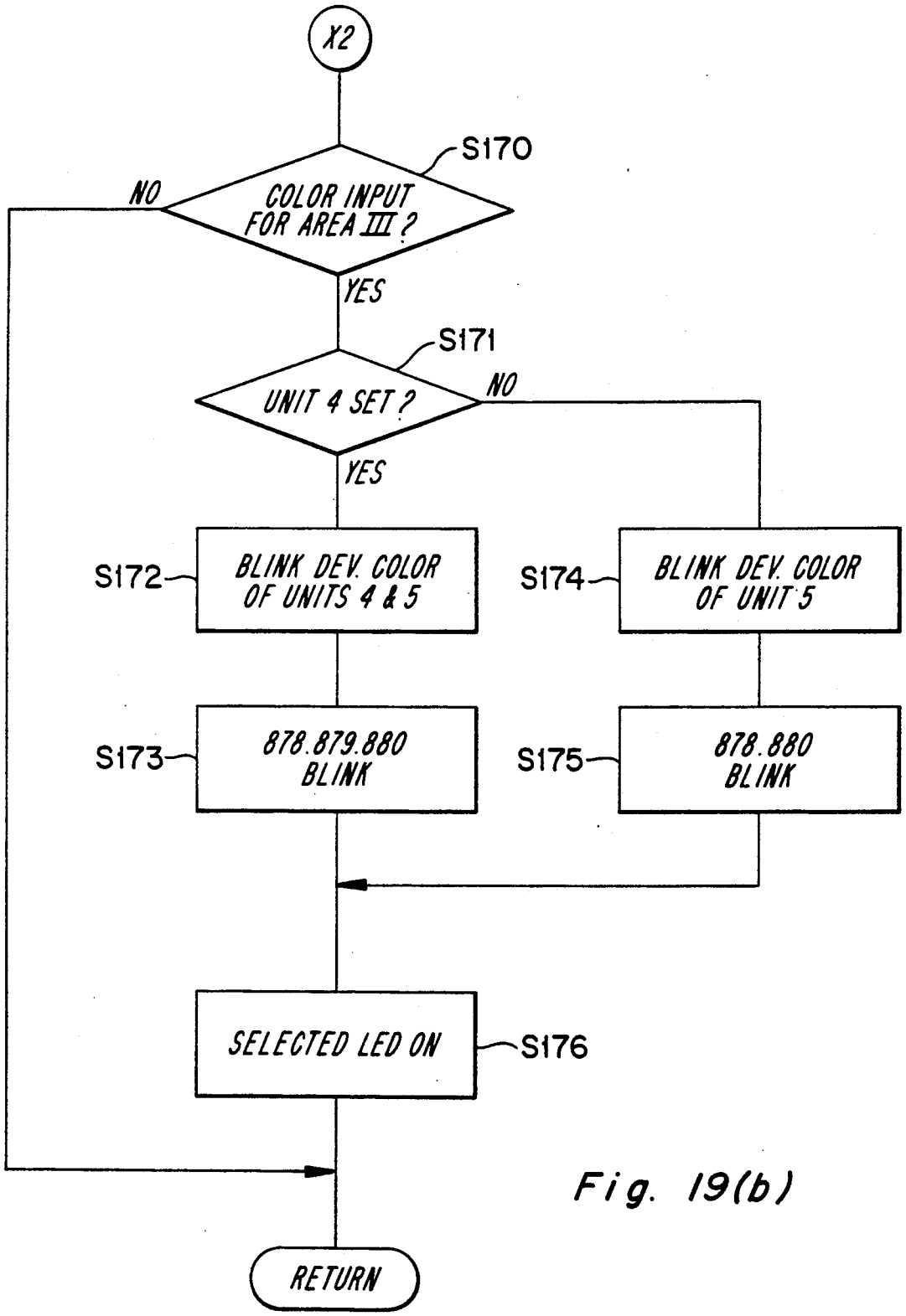

The details of the area editing subroutine executed at step S8 of the routine of FIG. 13 are shown in FIGS. 19(*a*) and 19(*b*). The area editing subroutine is used to specify either the developing color or the erasure for each area during a single color editing or during a bicolor editing which takes place during the composite copy mode.

Referring first to FIG. 19(*a*), when the area edit key 726 is depressed at step S141, a decision is made at step S142 to determine if a mode flag Fl is 0. The mode flag Fl is a flag which signifies that, when the value thereof is 1, either a color input mode for each area during the area editing or the setting of an area editing is established. If the mode flag Fl is not 0 as indicated by "NO" at step S142, the mode flag Fl is rendered to be 0 at step S147 to escape from the color input mode for each area and the light emitting diodes 95*a* to 95*c* are turned off while one of the light emitting diodes 95*a* to 95*c* which corresponds to the selected developing color is lit at step S148. At step S148, the light emitting diodes 872 to 880 are also turned off. If the mode flag F1 is 0 as indicated by "YES" at step S142, the mode flag F1 is rendered to be 1 at step S143 and the state is rendered to be 12 at step S144 to indicate the setting of the area I, followed by the lighting of respective color displays for the first and second developing units 4 and 5. Then, at step S146, the light emitting diode 833 is turned on to invite the inputting of the coordinates of the area I.

If the inputting of the coordinates of the area I has been completed, but the specification of the developing color for the area I has not yet been specified, it means a color inputting for the area I as indicated by "YES" at step S150 and, therefore, a process from step S151 to S158 is carried out to specify the developing color for the area I. In the first place, the state is rendered to be 17 at step S151 to show the setting of the area II. Then, if the first developing unit 4 has been set as indicated by "YES" at step S152, the developing colors of the first developing unit 4, which in the illustrated embodiment is used for color copying, and the second developing unit 5 which is detachable and is used for black copying, are caused to blink at step S153. Thereafter, in order to develop the area I in black or color, or in order to erase, the light emitting diodes 872, 873 and 874 are caused to blink at step S154. Where the first developing unit 4 has not yet been set as indicated by "NO" at step S152, the developing color of only the second developing unit 5 is caused to blink at step S155 and, in order to develop in black or erase since the color developing is not possible, the light emitting diodes 872 and 874 are caused to blink at step S156. One of the selection keys 732 to 734 which are then blinking is depressed to turn on a selected one of the light emitting diodes while the remaining light emitting diodes are turned off. Thereafter, the light emitting diode 883 is lit to invite the inputting of the coordinates for the area II. It is to be noted that, where at step S150 the color inputting for the area I has been done or the setting for the area I has not yet been done because the AREA SKIP key has been turned on, the program flow jumps to step S160.

Subsequently, in order to specify the developing color for the area II, a process from step S160 to S167 is carried out. The process from step S160 to S167 is similar to the process from step S150 to S158, except that at step S161 the state is rendered to be 0 to establish the stand-by condition. Also, since no inputting of the coordinates for the next adjacent area III is necessary, the light emitting diode 883 will not be lit.

Finally, in order to specify the developing color for the area III, a process from step S170 to S176 shown in FIG. 19(*b*) is carried out in a manner similar to that describe hereinabove.

By this area editing, the switching of the developing units for each area during the composite copy making and the erasure can be carried out by repeating the copying operation.

(g-8) Coordinate Setting

Figure 20:
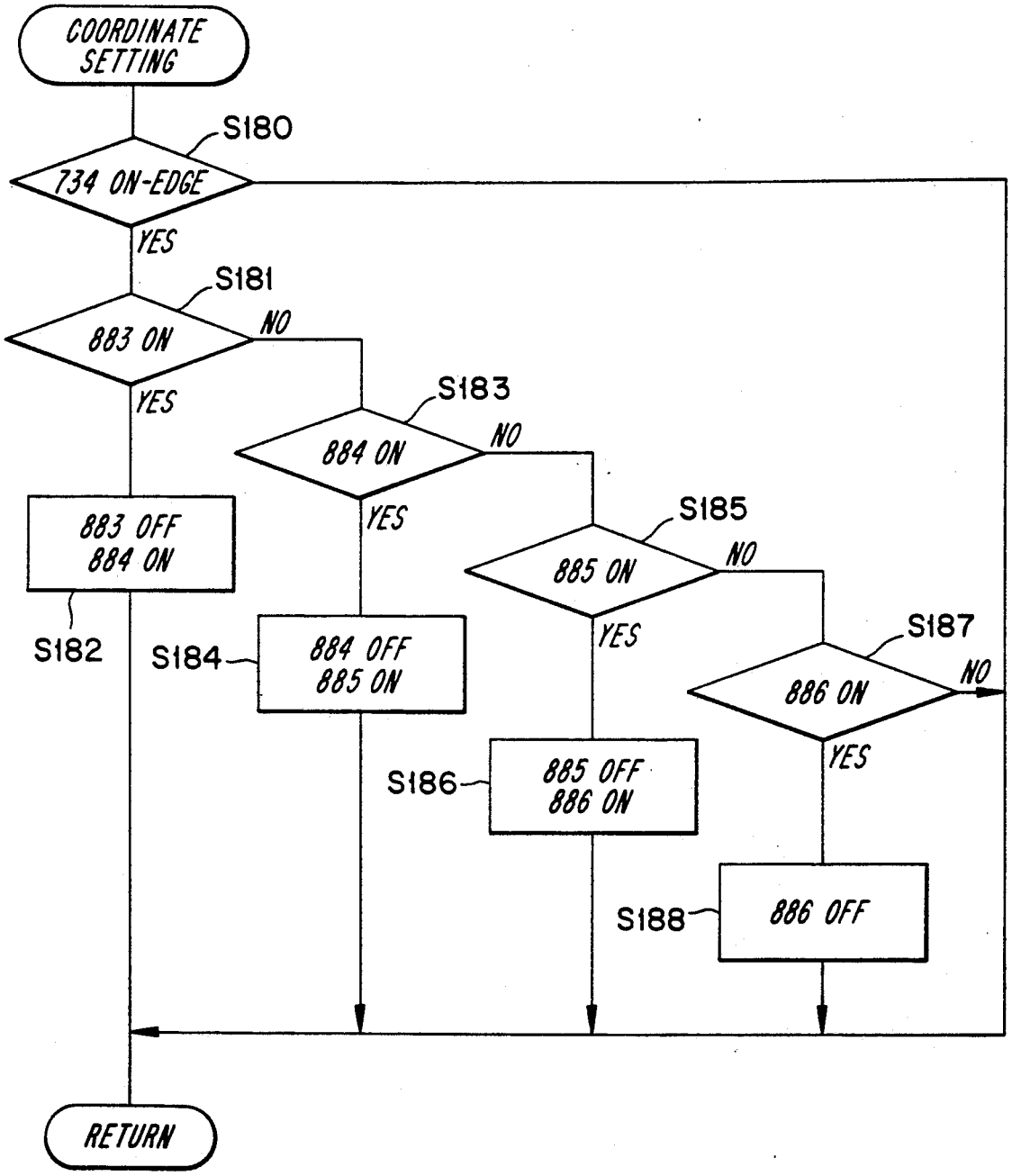

The details of the coordinate setting subroutine executed at step S9 of the routine of FIG. 13 are shown in FIG. 20. This coordinate setting subroutine is executed for the purpose of editing the area, that is, the setting of the coordinate, during the area edited copy mode.

Referring now to FIG. 20, when the selection key 734 is turned on at step S180, that is, the coordinates are inputted, a decision is made at step S181 to determine if the light emitting diode 883 is turned on and, if the light emitting diode 883 is on, the light emitting diodes 883 and 884 are turned off and lit, respectively, at step S182. On the other hand, if the light emitting diode 884 is on as indicated by "YES" at step S183, the light emitting diodes 884 and 885 are turned off and on, respectively, at step S184. If the light emitting diode 885 is on as indicated by "YES" at step S185, the light emitting diodes 885 and 886 are turned off and on, respectively, at step S186. Also, if the light emitting diode 886 is on as indicated by "YES" at step S187, the light emitting diode 886 is turned off at step S188.

This subroutine controls the ON- and OFF-states of the light emitting diodes 883 to 886 during the setting of the coordinates, and the actual setting thereof is carried out by means of the ten-key input sub-routine shown in FIGS. 22(*a*) and 22(*b*), reference to which will now be made.

Figure 22A:
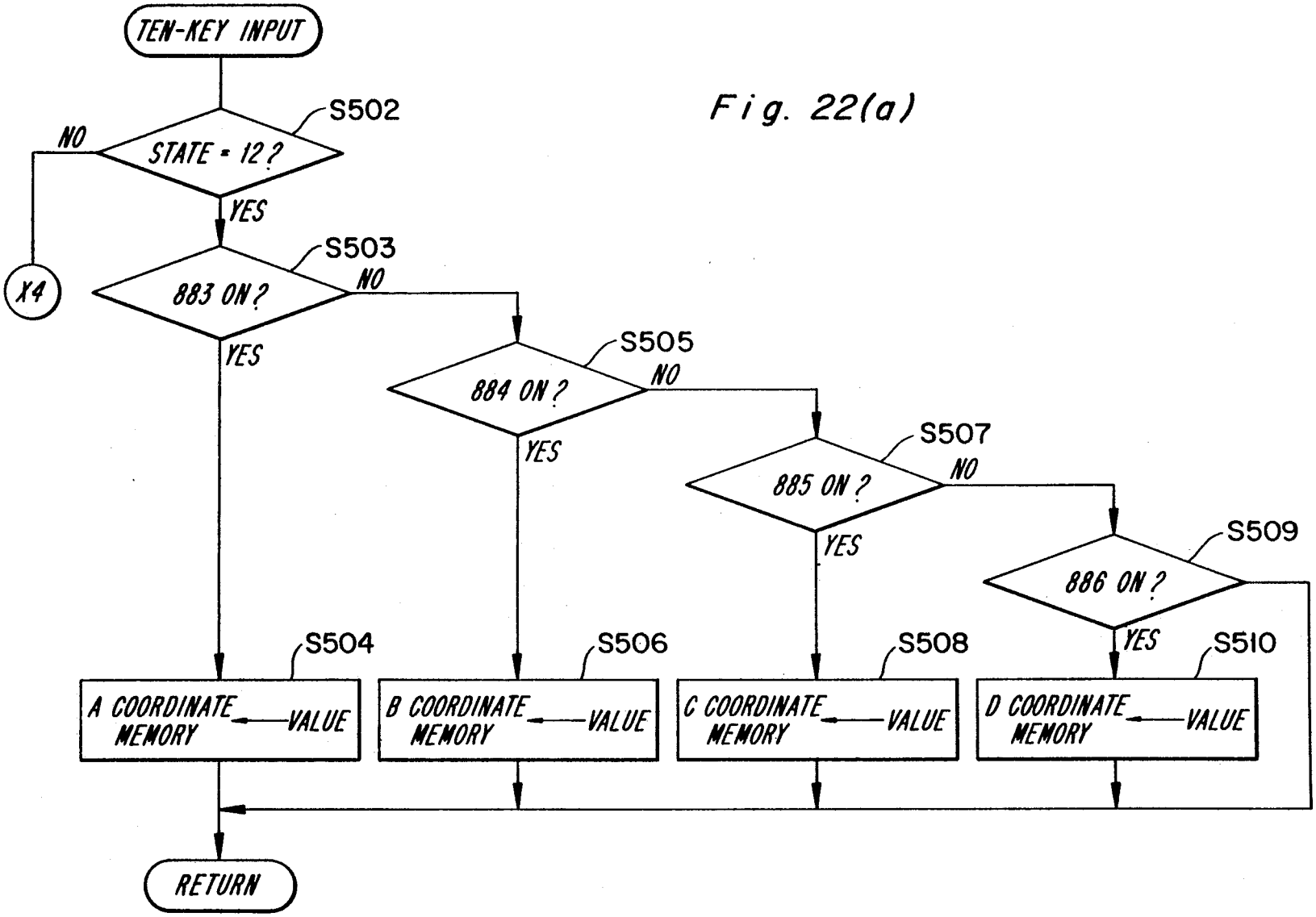
FIG. 22, comprised of FIGS. 22(*a*) and 22(*b*), is a flowchart showing a ten-key input routine.
Figure 22B:
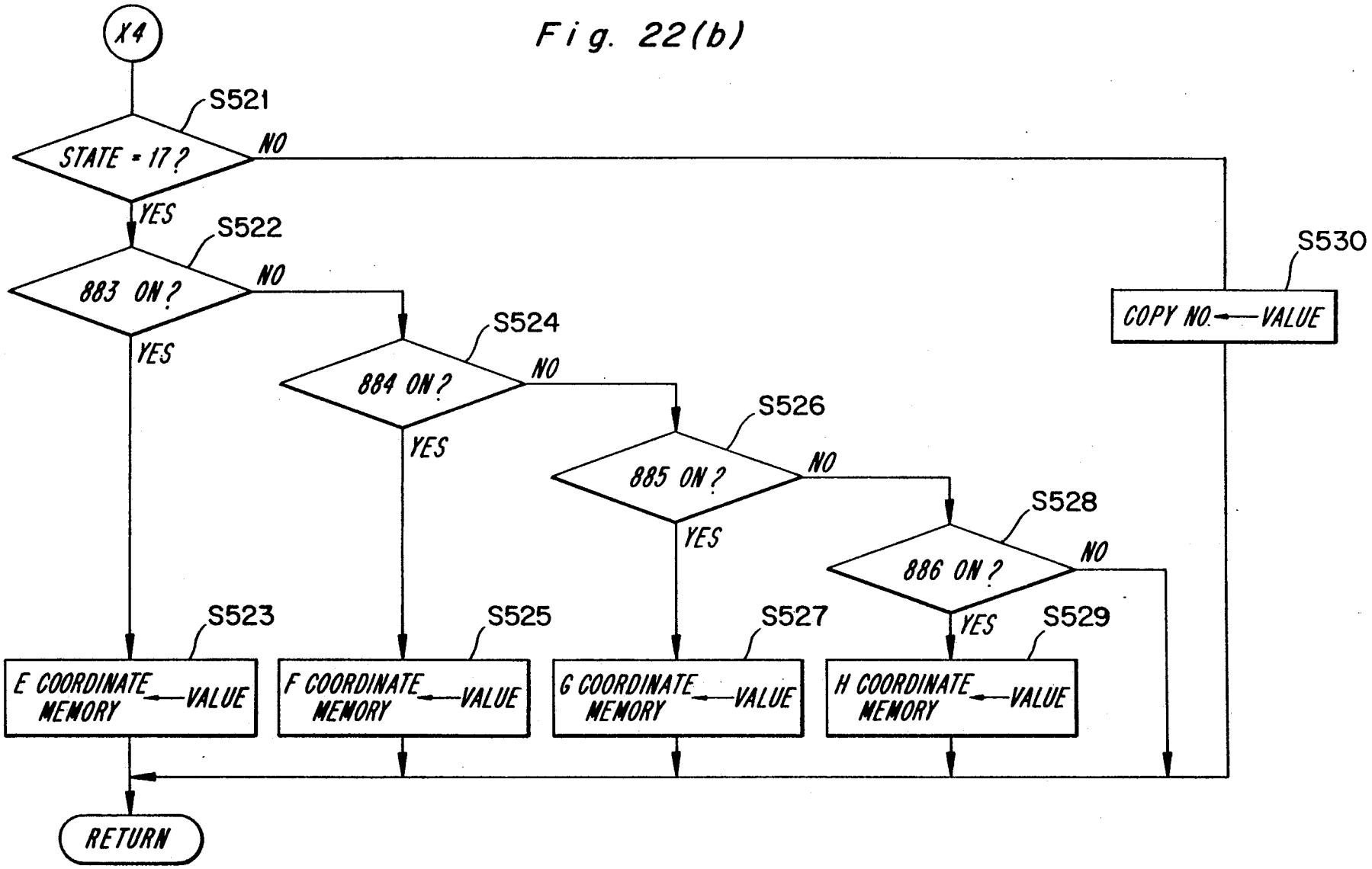

Referring to FIG. 22(*a*), at step S502, a decision is made to determine if the state is 12. If the state is 12 as indicated by "YES" at step S502, it means that the coordinate setting is for the area I and, therefore, the coordinates for the are I are stored by the execution of a process from step S502 to S510.

At subsequent step S503, a decision is made to determine the state of the light emitting diode 883 representative of the coordinate Xl. If the light emitting diode is on as indicated by "YES" at step S503 signifying the inputting of the coordinate Xl, a value inputted through the ten numerical keys are stored in an A coordinate at step S504.

Subsequent to the decision at step S503, decision is made to determine the respective states of the light emitting diode 884 representative of the coordinate X2, the light emitting diode 885 representative of the coordinate Y1 and the light emitting diode 886 representative of the coordinate Y2 at steps S505, S507 and S509, and if those light emitting diodes 884, 885 and 886 are turned on as indicated by "YES", values inputted through the ten numerical keys are stored in B, C and D coordinates at steps S506, S508 and S510, respectively. It is to be noted that the coordinates X1, X2, Y1 and Y2 for the area I are designated by A, B, C and D, respectively, and the coordinates X1, X2, Y1 and Y2 for the area II are designated by E, F, G and H, respectively.

If the state is not 12 as determined at step S502, the program flow proceeds to step S521 shown in FIG. 22(*b*) at which a decision is made to determine if the state is 17. If the state is 17 as indicated by "YES" at step S521 signifying that the setting of the coordinates is for the area II, values inputted through the ten numerical keys are stored in the coordinates E, F, G and H during the execution of a flow from step S522 to S529 in a manner similar to the storage of the coordinates for the area I.

Also, if the state is neither 12 nor 17, the value inputted through the ten numerical keys is set as the number of copies desired to be made at step S530.

(g-9) Simul Editing

Figure 21A:
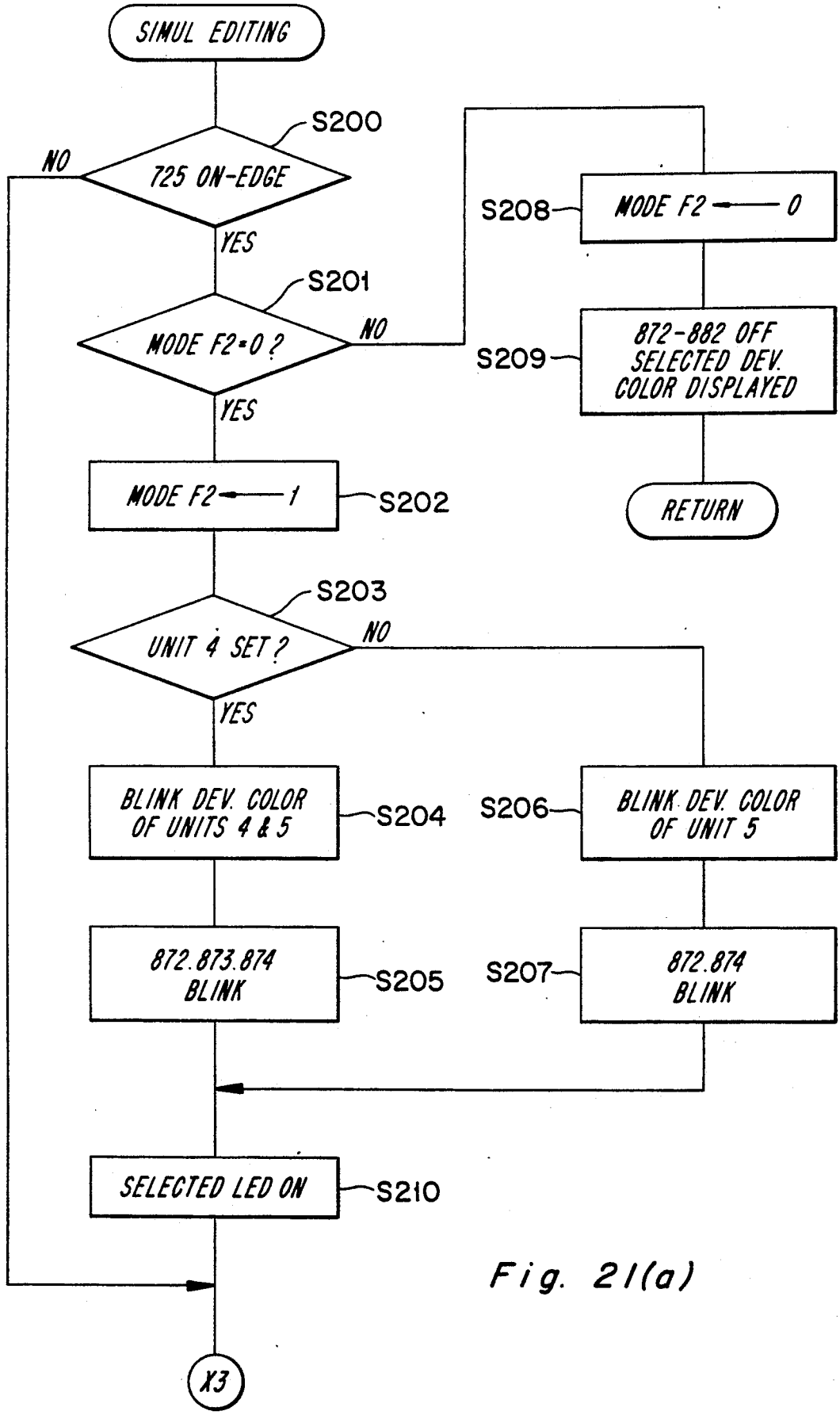
Figure 21B:
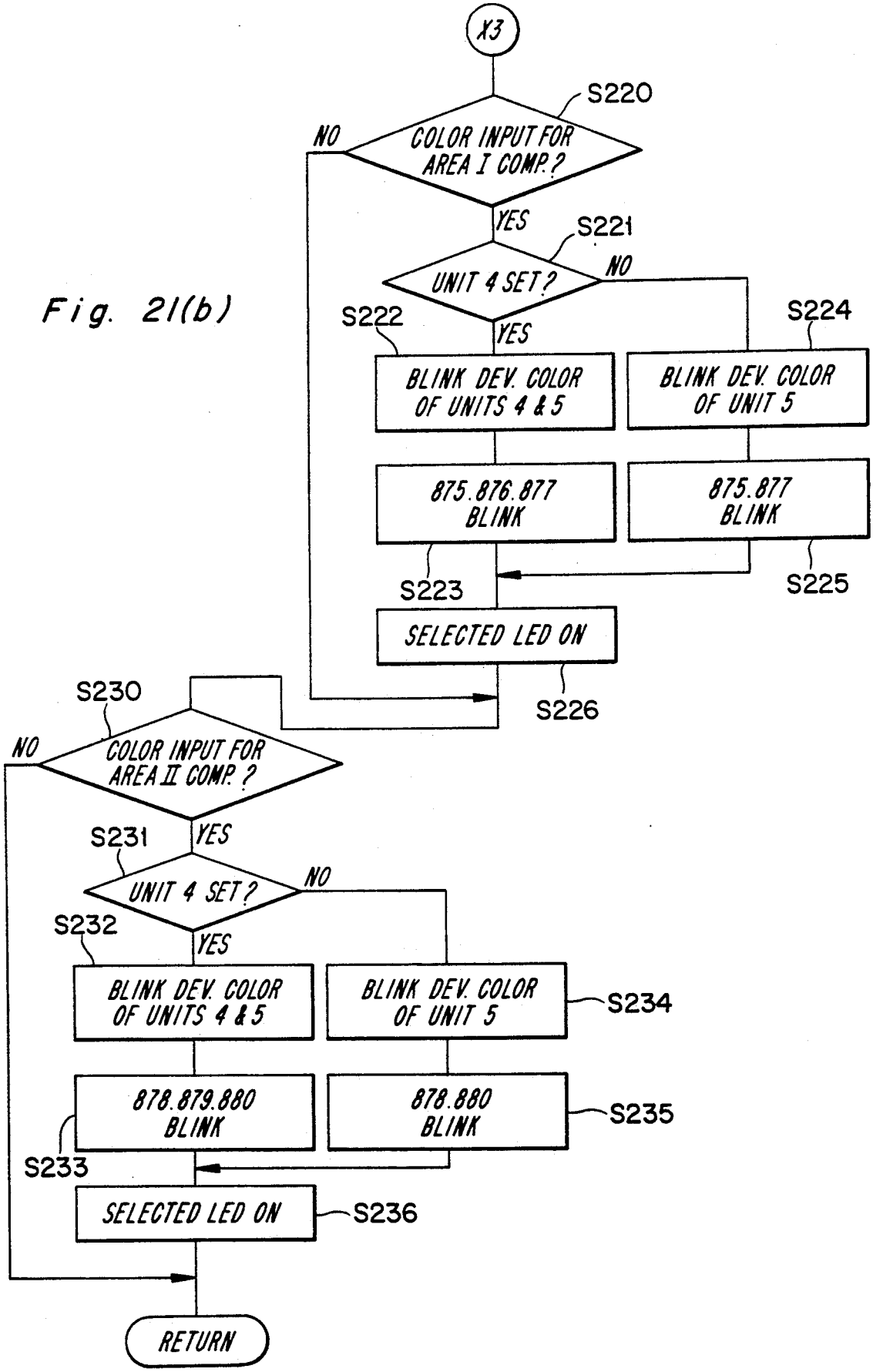

FIGS. 21(*a*) and 21(*b*) illustrates the details of the simul editing subroutine executed at step Sll of the routine of FIG. 13 and during the color simulcopy mode. The simul editing is for the purpose of specifying the developing color, or effecting an erasure, for each area defined by the position specifying mechanism 100.

When the simul edit key 725 is turned on as indicated by "YES" at step S200, a decision is made at step S201 to determine if a mode F2 is 0. If the result of the decision at step S201 indicates that the mode F2 is not 0, it means that the simul editing mode has already been established and, therefore, in order to release it, the mode F2 is rendered to be 0 at step S208, the light emitting diodes 872 to 882 are turned off, and the developing color already selected is displayed at step S209, with the program flow subsequently returning.

Where the result of the decision at step S201 indicates that the mode F2 is 0, the mode F2 is rendered to be 1 at step S202 to indicate that the simul editing mode is established, followed by a decision step S203 to determine if the first developing unit 4 has been set. If the result of the decision at step S203 indicates that the first developing unit 4 has not been set, the developing color of the second developing unit 5 is caused to blink at step S206 and the light emitting diodes 872 and 874 are caused to blink at step S206, followed by step S210. If the result of the decision at step S203 indicates that the first developing unit 4 has been set, the developing colors of the first and second developing units 4 and 5 are caused to blink at step S204 and the light emitting diodes 872, 873 and 874 are caused to blink at step S205, followed by step S210. At step S210, the light emitting diode then blinking is selected by depressing one of the selection keys 732, 733 and 734 with the selected light emitting diode consequently lit while the other light emitting diodes are turned off, and the display of the developing color is lit.

Then, after the color inputting for the area I is terminated as indicated by "YES" at step S220, the color inputting for the area II is carried out. For this purpose, a decision is made at step S221 to determine if the first developing unit 4 has been set, and if it has been set, the displays of the developing colors of the first and second developing units 4 and 5 are caused to blink and the light emitting diodes 875, 876 and 877 are caused to blink at steps S222 and L223. However, if it has not yet been set, the display of the developing color of the second developing unit 5 is caused to blink and the light emitting diodes 875 and 877 are caused to blink at steps S224 and S225, followed by the selection of one of the light emitting diodes then lit by depressing one of the selection keys 732, 733 and 734. Then, only the selected light emitting diode is lit while the other light emitting diodes are turned off, with the display of the developing color consequently lit at step S226.

In a manner similar to the color inputting for the area II executed during the flow from step S220 to S226, the color inputting for the area III is carried out during the flow from step S230 to S236.

(g-10) Other Process Subroutines

When and after the simul editing subroutine has been terminated, other processes such as the copy number setting, the copy density setting, the paper size selection, the FEATURE 1 selection, the FEATURE 2 selection and so on are carried out prior to the actual copying operation as shown by steps S12 to S17 in the routine of FIG. 13. However, these processes have no concern with the present invention and, therefore, will not be herein discussed.

According to the illustrated embodiment of the present invention, since the position specifying mechanism 100 is provided with the two slide levers, the bi-color simultaneous copying is possible with the document divided into three areas I to III. However, the present invention is not always limited thereto and, if the number of the slide levers of the position specifying mechanism 100 is increased and/or the number of the developing units is increased, the copying in three or more colors is possible with the document divided into four or more areas.

Also, in describing the preferred embodiment of the present invention, reference has been made that, during a period in which no development is effected, the motor 24 (24') is held still and the magnet roll 13 (13') is caused to rotate to retract the magnetic pole away from the developing station X to a position where it confronts the bristle height regulating member 19 (19'). However, the magnet pole need not be always moved in such manner when the development is effected and when no development is effected. However, the illustrated system is advantageous in that the possibility of the magnetic brush contacting the photoreceptor drum 1 can be reduced with the possibility of mixed color copying avoided consequently.

Again, while during the color simulcopy mode the developing unit is held still as a means for effecting the erasure, the present invention is not always limited thereto.

Thus, according to the present invention, the copying machine having both of the color simulcopy mode and the area edited copy mode is so designed that the specification of the developing color for each area during one of the modes and that during the other of the modes can be carried out on a common operating panel to minimize the complications which would result from a sophistication of the copying machine with an increased number of functions. Therefore, the copying machine according to the present invention is easy to handle with no substantially complicated procedures required. Also, the space saving can be attained in the operating panel and, therefore, the machine can be manufactured compact with a minimized number of various switches and light emitting diodes arranged on the operating panel. This in turn result in reduction of the manufacturing cost of the copying machine as a whole.

Although the present invention has fully been described in connection with the preferred embodiment thereof with reference to the accompanying drawings, it is to be noted that various changes and modifications are apparent to those skilled in the art. Such changes and modifications are, unless they depart from the scope of the present invention as defined by the appended claims, to be understood as included therein.

What is claimed is:

1. A copying machine which comprises:

a photosensitive medium;

a document support for the support thereon of a document to be copied;

an exposure means supported for movement between an exposure start position and an exposure terminating position, said exposure means, when moved from the exposure start position towards the exposure terminating position, scanning an entire surface of the document on the document support for projecting an image of the document onto the photosensitive medium;

a first area specifying means for specifying a particular point through which the scanning means is moved and operable to divide an area of the document support into a first area delimited between the exposure start position to the particular point, and a second area delimited between the particular point and the exposure terminating position;

a second area specifying means including a document coordinate input means and operable to divide the area of the document support into a third area defined by coordinates inputted and a fourth area outside the third area;

an image forming means including an electrostatic latent image forming means for forming an electrostatic latent image on the photosensitive medium in complemental relation with the image of the document, a first developing means accommodating therein a mass of developing material of first color and operable to supply the developing material onto the photosensitive medium to develop the electrostatic latent image into a visible powder image, a second developing means accommodating therein a mass of developing material of second color and operable to supply the developing material onto the photosensitive material to develop the electrostatic latent image into a visible powder image, an erasing means for erasing the electrostatic latent image before the electrostatic latent image is developed by one of the first and second developing means, and a transfer means for transferring the visible powder image from the photosensitive medium onto a copying sheet.

a common mode specifying means for specifying one of a first mode in which the electrostatic latent image on the photosensitive medium is developed into the visible powder image of first color with the use of the first developing means, a second mode in which the electrostatic latent image on the photosensitive medium is developed into the visible powder image of second color with the use of the second developing means, and a third mode in which the electrostatic latent image on the photosensitive medium is erased with the use of the erasing means;

a selecting means for selecting one of the first and second area specifying means; and a mode control means operable to utilize the common mode specifying means to specify a mode relative to any one of the first and second areas when the first area specifying means is selected and to utilize the common mode specifying means to specify a mode relative to any one of the third and fourth areas when the second area specifying means is selected.

2. The copying machine as claimed in claim 1, further comprising an image formation control means operable to control the image forming means to enable an image of each of the areas to be formed on the copying sheet under a mode specified during a single scanning run of the exposure means when the first area specifying means to enable an image of each of the areas to be formed means to enable an image of each of the areas to be formed on the copying sheet under a mode specified during two scanning runs of the exposure means when the second area specifying means is selected.

3. A copying machine which comprises:

a photosensitive medium;

a document support for the support thereon of a document to be copied;

an exposure means supported for movement between an exposure start position and an exposure terminating position, said exposure means, when moved from the exposure start position towards the exposure terminating position, scanning an entire surface of the document on the document support for projecting an image of the document onto the photosensitive medium;

a first area specifying means including first and second lever members supported for movement along the document support for specifying a first and a second particular points, respectively, through which the scanning means is moved, said second particular point adjacent the exposure terminating position, whereby the area of the document support is divided into a first area delimited between the exposure start position and the first particular point, a second area delimited between the first particular point and the second particular point and a third area delimited between the second particular point and the exposure terminating position;

a second area specifying means including a document coordinate input means and operable to divide the area of the document support into a fourth area defined by coordinates inputted and a fifth area outside the fourth area;

an image forming means including an electrostatic latent image forming means for forming an electrostatic latent image on the photosensitive medium in complementary relation with the image of the document, a first developing means accommodating therein a mass of developing material of first color and operable to supply the developing material onto the photosensitive medium to develop the electrostatic latent image into a visible powder image, a second developing means accommodating therein a mass of developing material of second color and operable to supply the developing material onto the photosensitive material to develop the electrostatic latent image into a visible powder image, an erasing means for erasing the electrostatic latent image before the electrostatic latent image is developed by one of the first and second developing means, and a transfer means for transferring the visible powder image from the photosensitive medium onto a copying sheet;

a common mode specifying means for specifying one of a first mode in which the electrostatic latent image on the photosensitive medium is developed into the visible powder image of first color with the use of the first developing means, a second mode in which the electrostatic latent image on the photosensitive medium is developed into the visible powder image of second color with the use of the second developing means, and a third mode in which the electrostatic latent image on the photosensitive medium is erased with the use of the erasing means;

a selecting means for selecting one of the first and second area specifying means; and a mode control means operable to utilize the common mode specifying means to specify a mode relative to any one of the first, second and third areas when the first area specifying means is selected and to utilize the common mode specifying means to specify a mode relative to any one of the fourth and fifth areas when the second area specifying means is selected.

4. A copying machine which comprises:

means for forming an image of a document, said means operable in a plurality of different copy modes;

first area designating means for designating a plurality of first arbitrary area of document;

second area designating means for designating a plurality of second arbitrary area of the document, said second area designating means being operable independently from the first area designating means;

selecting means for selectively selecting one of said area designating means;

common mode specifying means for specifying relative to each of said first areas one of said copy modes respectively when said first designating means is selected and for specifying relative to each of said second areas one of said copying modes respectively when said second designating means is selected; and control means for controlling the image forming means to allow the image of each area to be formed under one of the modes specified by said common mode specifying means.

5. The copying machine as claimed in claim 4, wherein said image forming means includes a document support member for supporting thereon the document; wherein said first area designating means includes lever member movable along said document support for specifying the first area; and wherein said second area designating means includes numerical value input means for inputting numerical values which specify the second areas.

* * * * *